US008079112B2

(12) United States Patent
Michelson et al.

(10) Patent No.: US 8,079,112 B2
(45) Date of Patent: Dec. 20, 2011

(54) DISPOSABLE LIQUID ABSORBING CLEANING PAD FOR A HAND HELD CLEANING IMPLEMENT HAVING AN ELONGATED HANDLE

(75) Inventors: Robert Michelson, Wayland, MA (US); Robert Cavalcanti, Shrewsbury, MA (US); Michael Silverman, Westborough, MA (US)

(73) Assignee: Butler Home Products, LLC, Marlborough, MA (US)

( * ) Notice: Subject to any disclaimer, the term of this patent is extended or adjusted under 35 U.S.C. 154(b) by 1239 days.

(21) Appl. No.: 11/700,326

(22) Filed: Jan. 31, 2007

(65) Prior Publication Data

US 2007/0192978 A1 Aug. 23, 2007

Related U.S. Application Data

(63) Continuation-in-part of application No. 11/529,558, filed on Sep. 28, 2006, which is a continuation-in-part of application No. 11/280,962, filed on Nov. 16, 2005.

(60) Provisional application No. 60/628,734, filed on Nov. 17, 2004.

(51) Int. Cl.
*A47L 13/144* (2006.01)
*A47L 13/46* (2006.01)

(52) U.S. Cl. ..... 15/244.1; 15/244.4; 15/228; 15/116.2; 15/119.2; 15/147.1

(58) Field of Classification Search ..... 15/244.1, 15/244.4, 228, 176.3, 116.1, 116.2, 119.1, 15/119.2, 147.1
See application file for complete search history.

(56) References Cited

U.S. PATENT DOCUMENTS

| | | | | |
|---|---|---|---|---|
| 2,108,727 | A * | 2/1938 | Rogers | 15/119.2 |
| 2,201,079 | A * | 5/1940 | Camden | 15/119.2 |
| 2,717,406 | A | 9/1955 | Herman et al. | |
| 2,912,710 | A | 11/1959 | Vosbikian et al. | |
| 3,178,749 | A | 4/1965 | Heepe | |
| 3,188,676 | A | 6/1965 | Zelinski et al. | |
| 3,355,844 | A | 12/1967 | Abler et al. | |
| 3,727,259 | A | 4/1973 | Wilson | |
| 4,285,086 | A | 8/1981 | Whyte | |
| 4,468,832 | A | 9/1984 | Batchelor | |
| 4,509,224 | A | 4/1985 | Batchelor | |
| 4,654,920 | A | 4/1987 | O'Neil, Jr. et al. | |
| 4,882,804 | A | 11/1989 | Lucas | |
| 4,908,901 | A * | 3/1990 | Torres | 15/119.1 |
| 5,371,917 | A | 12/1994 | Hoagland | |
| 5,406,667 | A | 4/1995 | Teufel et al. | |
| 5,416,945 | A | 5/1995 | Price | |
| 5,488,750 | A | 2/1996 | Vosbikian et al. | |

(Continued)

*Primary Examiner* — Gary Graham
(74) *Attorney, Agent, or Firm* — McCarter & English LLP

(57) ABSTRACT

A disposable liquid absorbing cleaning pad for a hand held cleaning implement having an elongated handle includes a layer of sponge material, a layer of flexible open cell foam material made from melamine resin fixedly attached to the layer of sponge material and attachment structure fixedly secured to the layer of sponge material for removably attaching the cleaning pad to the cleaning implement. In one embodiment of the invention the attachment structure includes a backing plate which is fixedly mounted onto the layer of sponge material and a pair of wing screw assemblies which are removably and slidably mounted on the backing plate for removably attaching the cleaning pad to the cleaning implement. In using the hand held cleaning implement the layer of flexible open cell foam material made from melamine resin is the layer that contacts the surface to be cleaned.

6 Claims, 25 Drawing Sheets

U.S. PATENT DOCUMENTS

| | | | | |
|---|---|---|---|---|
| RE37,415 | E | 10/2001 | Petner | |
| 6,490,749 | B1 * | 12/2002 | Morad | 15/145 |
| 6,503,615 | B1 | 1/2003 | Horii et al. | |
| 6,608,118 | B2 | 8/2003 | Kosaka et al. | |
| 6,725,494 | B2 | 4/2004 | Cann | |
| 7,234,189 | B2 | 6/2007 | Chen | |
| 2005/0028309 | A1 | 2/2005 | Boyer et al. | |
| 2005/0136238 | A1 | 6/2005 | Lindsay et al. | |
| 2006/0003912 | A1 | 1/2006 | Lindsay et al. | |
| 2006/0005338 | A1 | 1/2006 | Ashe et al. | |
| 2006/0229229 | A1 | 10/2006 | Bednarz et al. | |
| 2006/0230569 | A1 | 10/2006 | Chen | |
| 2007/0061991 | A1 | 3/2007 | Gonzales et al. | |
| 2007/0130710 | A1 | 6/2007 | Chen et al. | |
| 2007/0151064 | A1 | 7/2007 | O'Connor et al. | |
| 2007/0161533 | A1 | 7/2007 | Gonzales et al. | |
| 2008/0016640 | A1 | 1/2008 | Reddy et al. | |

* cited by examiner

DISPOSABLE LIQUID ABSORBING CLEANING PAD FOR A HAND HELD CLEANING IMPLEMENT HAVING AN ELONGATED HANDLE

CROSS-REFERENCE TO RELATED APPLICATIONS

The present application is a continuation in part of U.S. patent application Ser. No. 11/529,558 filed on Sep. 28, 2006, which is a continuation in part of U.S. patent application Ser. No. 11/280,962 filed on Nov. 16, 2005, which claims the benefit under 35 USC 119(e) of U.S. Provisional Patent Application Ser. No. 60/628,734, filed Nov. 17, 2004, both of which documents are incorporated herein by reference.

BACKGROUND OF THE INVENTION

The present invention relates, in one aspect, to a disposable liquid absorbing cleaning pad for use in a hand held cleaning implement of the type having an elongated handle. One well known type of hand held cleaning implement having an elongated handle and which uses a disposable liquid absorbing cleaning pad is the sponge mop. In a second aspect, the present invention relates to improved backing plates or attachment structures for disposable liquid absorbing cleaning pads for attaching the cleaning pads to the elongated handle.

Sponge mops are well known and widely used for cleaning hard surfaces, including flooring surfaces such as hardwood floors, ceramic tile floors, marble floors and the like. The liquid with which these mops are intended to be used is usually water or some type of aqueous cleaning solution. Sponge mops usually include an elongated handle, a disposable liquid absorbing cleaning pad having a layer of sponge material which is used for cleaning and moisture absorbing and a head. The cleaning pad also includes an attachment structure for attaching the cleaning pad to the head of the mop, the construction of the attachment structure depending on the particular type of mop. After being used a number of times, the cleaning pad is usually discarded and replaced with a refill cleaning pad. Examples of the layer of sponge material are natural sponges, polyester foams, polyurethane foams, cellulose and absorbent arrays of synthetic fibers.

The three most common types of sponge mops are the squeeze mop, the butterfly mop and the roller mop.

One very well known type of squeeze mop includes a handle, a head attached to the handle, a mounting plate attached to the head, a disposable liquid absorbing cleaning pad which includes a layer of sponge material and a backing plate, the layer of sponge material being fixedly secured to the backing plate, means for removably attaching the backing plate to the mounting plate and a squeeze plate hingedly attached to the mounting plate for extracting liquid collected by the cleaning pad during use and for rinsing the cleaning pad.

Butterfly mops differ from squeeze mops among other things in that the cleaning pad is mounted on a pair of hinged wing plates which are coupled to the head of the mop rather than a mounting plate. The pair of hinged wing plates can open and close in much the same way as the wings do on a butterfly in order to remove liquid from the cleaning pad.

Roller mops differ from squeeze mops among other things in that they include a pair of rollers rather than a squeeze plate for squeezing water from the cleaning pad.

Sponge mops very often also include a layer of scrubber material or a scrubber brush for cleaning excessively soiled areas.

In U.S. Pat. No. 4,285,086 to A. J. Whyte, there is disclosed a squeeze mop which includes a compressible head of sponge rubber or the like and a wringing mechanism which comprises a presser plate pivotal into compressive engagement with the mop head, an operating lever pivotally mounted on the mop handle, a cam lever pivotally connected to the operating lever and a cam disposed on the end of the cam lever such that actuation of the operating handle causes the cam to reciprocate over the surface of the presser plate while pivotally urging the presser plate into compressive engagement with the mop head.

In U.S. Pat. No. 5,416,945 to W. D. Price, there is disclosed a squeeze mop which comprises a backing plate upon which both a sponge and a scrubber strip have been separately mounted so as to expose an edge of the backing plate having the scrubber strip for use as a cleaning tool. The backing plate may be heated and thereafter the sponge may be heat fused to the backing plate and the scrubber strip may be heat fused to the backing plate in perpendicular fashion to the sponge so as to expose an edge of the backing plate for use as a cleaning tool.

In U.S. Pat. No. 6,725,494 to R. A. Cann, there is disclosed a butterfly mop which includes a self-contained wringing mechanism comprising only two molded parts, an actuating lever and an enclosed yoke. A pair of hinged wings can be internally molded onto one end of the actuating lever, and the lever can rotate back and forth within the enclosed yoke. Guides within the yoke can swing the wings closed when the lever is moved forward, squeezing a detachable pad. The mechanical advantage of the actuating lever can be increased as it is moved forward. Moving the lever back to its original position can cause the wings to swing back open, aided by the compression of the sponge.

In U.S. Pat. No. 5,488,750 to P. S. Vosbikian, there is disclosed a butterfly mop which is used for routine surface cleaning and moisture absorbing mopping and an integral unitary mop scrubber attachment with an outer abrasive surface which is to be used on the head of the sponge mop for cleaning more difficult and ingrained soiled surfaces. The mop scrubber attachment consists of two detent tabs which are to be inserted into the existing cutouts located in the sponge support member of the mop. The scrubber attachment also has side holes for placement over the existing holes of the mop's support member, through which the ends of the mop's squeeze arms are inserted. The mop scrubber attachment is readily and easily removable from the sponge mop and is interchangeably designed to be used with existing or new butterfly sponge mops. In another embodiment the mop scrubber attachment and the mop's sponge support member is formed with the scrubber component as a single, molded plastic component.

In U.S. Pat. No. 3,727,259 to F. G. Wilson, there is disclosed a roller mop which comprises a wringer mop head replacement and actuator mechanism including a pair of spaced parallel wringer rollers carried at the lower end of a housing through which housing extends an operating crank upward through a hollow handle to pivotal securement with a pivoted crank handle, and which operating crank detachably connects at its lower end to the mop head by means of a cooperating snap-latch carried by the mop head. The crank handle is shiftable between up and detented center positions to similarly shift the operating crank and wring out the mop head by passing it between the rollers, and is shiftable to a down position to expel the mop head and lower end of the operating crank from the housing and from between the rollers to completely expose the snap-latch connection for fast mop head replacement. The mop head snap-latch consists of an inverted channel member holding a sponge absorbent element by compression of a marginal edge of the sponge between the channel member walls, the center of the channel base wall having an upstanding tunnel formation into which the operating crank lower end hook arm is slidable with the latter held in position by a shiftable latch plate biased resiliently upward by the sponge material to capture the hook arm.

In U.S. Patent Application Publication No. 2005/0028309A1 there is disclosed a butterfly mop having an elongate shaft with a mop element disposed at one end of the shaft and a wringer connected to the shaft and the mop element. In preferred embodiments, the wringer includes a channel body having first and second leg portions defining a channel there between. The mop element includes a foldable, compressible, liquid-absorbent member, a mounting element having first and second support portions connected by a flexible member, and a scrubber mounted to the mounting element. The mop element and channel body are movable relative to one another, whereby the mop element may be drawn into the channel causing the mop element to fold along a central transverse axis and to become compressed between the channel body leg portions. The wringer includes a handle and an actuator link connecting the handle to one of the mop element and channel body for effecting relative hinged movement thereof. In some embodiments, the mop element includes a support that has first and second support portions and a flexible member connecting the first and second support portions. In certain embodiments, a fastener having a barbed shaft is used to connect the mop element to the wringing mechanism to the mop.

In U.S. Pat. No. 4,654,920 to W. J. O'Neil, Jr. et al. there is disclosed a roller mop having a scrubber attachment which is fixedly mounted thereon without any extra, attaching hardware. The scrubber attachment carries a scrubber pad and is fixedly secured to the mop head at a predetermined angle. This combination yields a mop capable of both conventional sponge cleaning and of abrasively rubbing to effect further cleansing treatment of a surface without the risk of moving the scrubber out of operative position during use.

In U.S. RE 37,415E there is disclosed roller sponge mop which is used for routine floor surface or similar surface cleaning and moisture absorbing mopping is combined with an integral mop attachment with an outer abrasive surface, designed and formed to be positioned within a wall surface of the lower frame ofthe mop, to be used for cleaning more difficult and ingrained soiled surfaces. The attachment is removable and interchangeable for use on similarly configured roller mops. The sponge mop roller squeeze feature is actuated by a cammed lever which is rotatably connected to the mop's handle and is positioned adjacent to a sleeve slidable mounted on the handle. At its lower end, the sleeve comprises the frame which carries the mop attachment and connects to the mop's rollers. The bias action of a spring at the lower end of the handle maintains the sponge element of the mop in the cleaning position. As the lever is moved against the sleeve and toward the rollers, the handle is caused to move away from the rollers, drawing the sponge element between the rollers, squeezing dirt and water out of the sponge member. Releasing the lever causes the spring to return the handle and the sponge member to the cleaning position. Tabs on the sleeve and camming lever interact to lock the sleeve and handle to hold and maintain the sponge element between the rollers independent of the use of manually exertion. In this manner, the abrasive surface can be sued without interference from the extended sponge element. A handle attachment piece is secured at one end to the handle and at the other end comprises bottom walls. The bottom walls are self-aligning with corresponding ridged openings on the channel member which holds the sponge element. This alignment system allows for simply and easily replacement ofthe sponge element of the mop.

There is currently in the marketplace a hand held disposable liquid absorbing cleaning pad especially useful in cleaning walls, bathroom and kitchen fixtures and the like which is rectangularly shaped and which consists of a layer of sponge material bonded to a layer of flexible open cell foam material made from melamine resin. The layer of flexible open cell foam material is manufactured by BASF Corporation in Ludingshaffen, Germany and sold under the name BASOTECT. The layer of flexible open cell foam material made from melamine resin and bonded to the layer of sponge material is marketed by Proctor & Gamble in Cincinnati, Ohio under the name Magic Eraser. In use, the layer of open cell foam material is the layer that contacts the surface to be cleaned. The length, width and thickness of the pad is about 4 ¾ inches by 2 ½ inches by 1 1/16 inches and the thickness of the layer of flexible open cell foam material is about ⅞ of an inch.

Although sponge mops comprising a disposable liquid absorbing cleaning pad are generally adequate for their intended purpose, they are not always completely satisfactory in successfully removing all types of soils from hard surfaces.

Also, because of structural differences in the mop heads, a refill cleaning pad made for one manufacturer's mop will not always fit onto another manufacturer's mop of the same type. Accordingly, it is an object of this invention to provide a new and improved hand held cleaning implement of the type having an elongated handle and a disposable liquid absorbing cleaning pad.

It is another object of this invention to provide a disposable liquid absorbing cleaning pad for a hand held cleaning implement which has a backing plate constructed such that the cleaning pad can be used with more than one type of hand held cleaning implement.

It is still another object of this invention to provide a new and improved refill for a hand held cleaning implement of the type having an elongated handle and a disposable liquid absorbing cleaning pad.

SUMMARY OF THE INVENTION

According to one aspect of this invention there is provided a disposable liquid absorbing cleaning pad for a squeeze mop, the squeeze mop having a head, a mounting plate on the head onto which the cleaning pad can be mounted and a squeeze plate attached to the mounting plate, the disposable liquid absorbing cleaning pad comprising a layer of sponge material, a layer of a flexible open cell foam material made from melamine resin fixedly attached to the layer of sponge material, a backing plate fixedly mounted onto the layer of sponge material and means for removably attaching the backing plate onto the mounting plate.

According to another aspect of this invention there is provided a disposable liquid absorbing cleaning pad for a butterfly mop, the butterfly mop having a pair of pivotally mounted base plates, the disposable liquid absorbing cleaning pad comprising a layer of sponge material, a layer of a flexible open cell foam material made from melamine resin fixedly attached to the layer of sponge material and a backing plate fixedly mounted onto the layer of sponge material, the backing plate being adapted to be removably mounted on the pair of pivotably mounted base plates.

According to another aspect of this invention there is provided a disposable liquid absorbing cleaning pad for a roller mop, the roller mop having a pair of rollers and an operating crank, the disposable liquid absorbing cleaning pad comprising a layer of sponge material, a layer of a flexible open cell foam material made from melamine resin fixedly attached to the layer of sponge material, and an operating crank holder attached to the layer of sponge material and adapted to be removably attached to the operating crank.

According to another aspect of this invention there is provided a disposable liquid absorbing cleaning pad for a hand held cleaning implement of the type having an elongated handle and a head, the liquid absorbing cleaning pad comprising a layer of sponge material, a layer of a flexible open cell foam material made from melamine resin fixedly attached to the layer of sponge material, a backing plate fixedly mounted onto said layer of sponge material and having a pair of longitudinally disposed slotted pockets for attaching said backing plate onto either one of two differently constructed hand held cleaning implements.

According to another aspect of this invention there is provided a disposable liquid absorbing cleaning pad for a hand held cleaning implement having an elongated handle having a head, and attachment structure on the head onto which the cleaning pad can be mounted, and a handle, the disposable liquid absorbing cleaning pad comprising a layer of sponge material, a layer of a flexible open cell foam material made from melamine resin fixedly attached to the layer of sponge material, a backing plate fixedly mounted onto the layer of sponge material and means for removably attaching the backing plate onto the attachment structure on the hand held cleaning implement.

According to another aspect of this invention there is provided a disposable liquid absorbing cleaning pad for a butterfly mop, the butterfly mop having a pair of pivotally mounted base plates, the disposable liquid absorbing cleaning pad comprising a layer of sponge material, a layer of a flexible open cell foam material made from melamine resin fixedly attached to the layer of sponge material and a backing plate fixedly mounted onto the layer of sponge material, the backing plate being adapted to be removably mounted on the pair of pivotally mounted base plates.

According to another aspect of this invention there is provided a disposable liquid absorbing cleaning pad for a mop having rollers, the disposable liquid absorbing cleaning pad comprising a layer of sponge material, a layer of a flexible open cell foam material made from melamine resin fixedly attached to the layer of sponge material, and means attached to the layer of sponge material for removably attaching the cleaning pad to the mop.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description of preferred embodiments is therefore, to be taken in an illustrative, rather than in a limiting, sense.

BRIEF DESCRIPTION OF THE DRAWINGS

In the drawings wherein like characters represent like parts.

DETAILED DESCRIPTION OF THE PREFERRED EMBODIMENTS

The present invention is directed to a hand held cleaning implement of the type having an elongated handle and a disposable liquid absorbing cleaning pad in which the cleaning pad comprises a layer of open cell foam material made from melamine resin and a layer of sponge material. The layer of open cell foam material is used for cleaning and moisture absorbing. The present invention is also directed to disposable liquid absorbing cleaning pads having backing plates or attachment structures which can be used with a variety of differently constructed squeeze mops.

Figure 1:
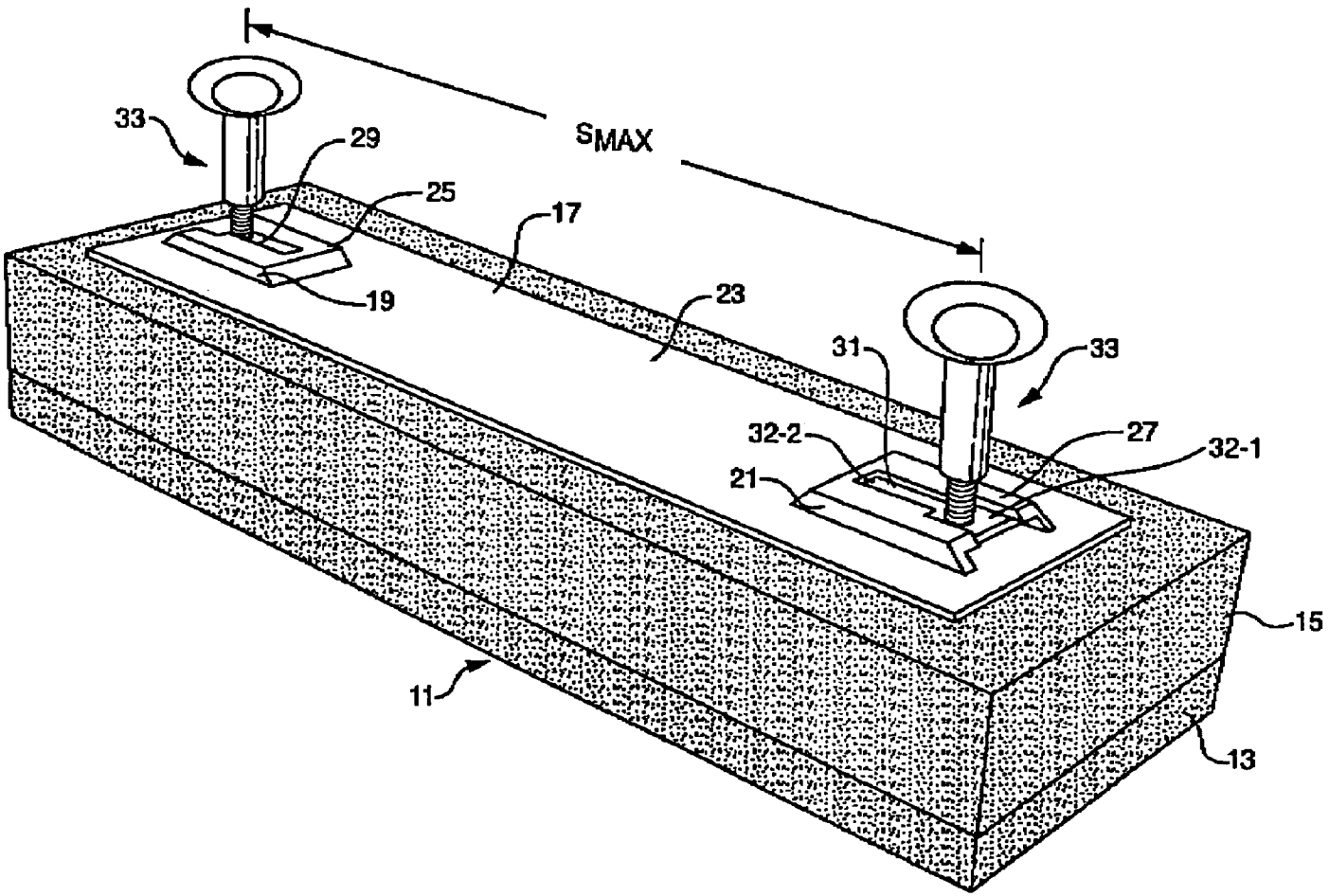
FIG. 1 is a perspective view taken from the top of one embodiment of a cleaning pad constructed according to this invention for use with one type of squeeze mop, the cleaning pad having a backing plate and a pair of wing screw assemblies, the wing screw assemblies being arranged in the pockets on the backing plate for maximum spacing.
Figure 2:
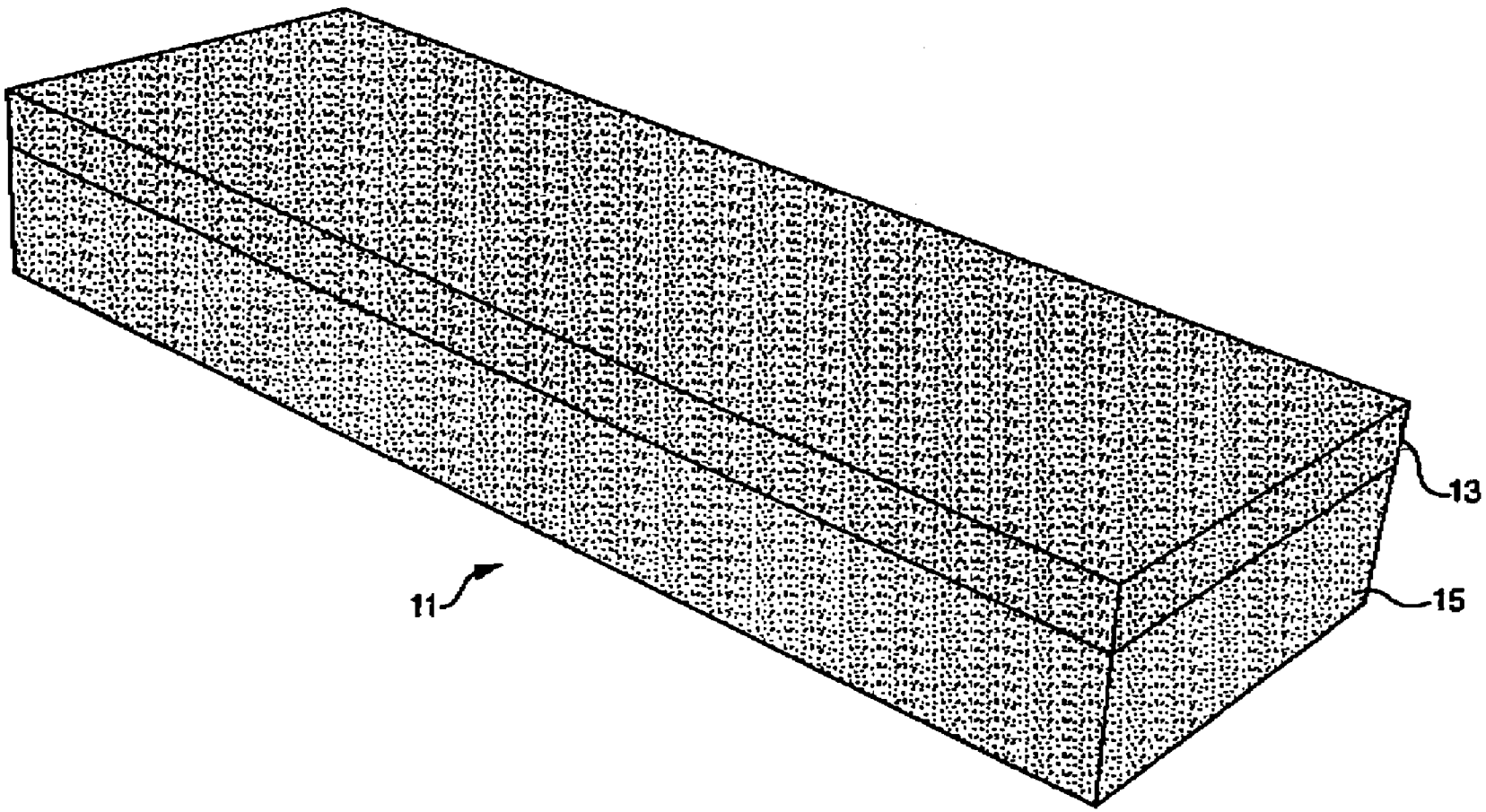
FIG. 2 is a perspective view taken from the bottom of the cleaning pad shown in FIG. 1.
Figure 3:
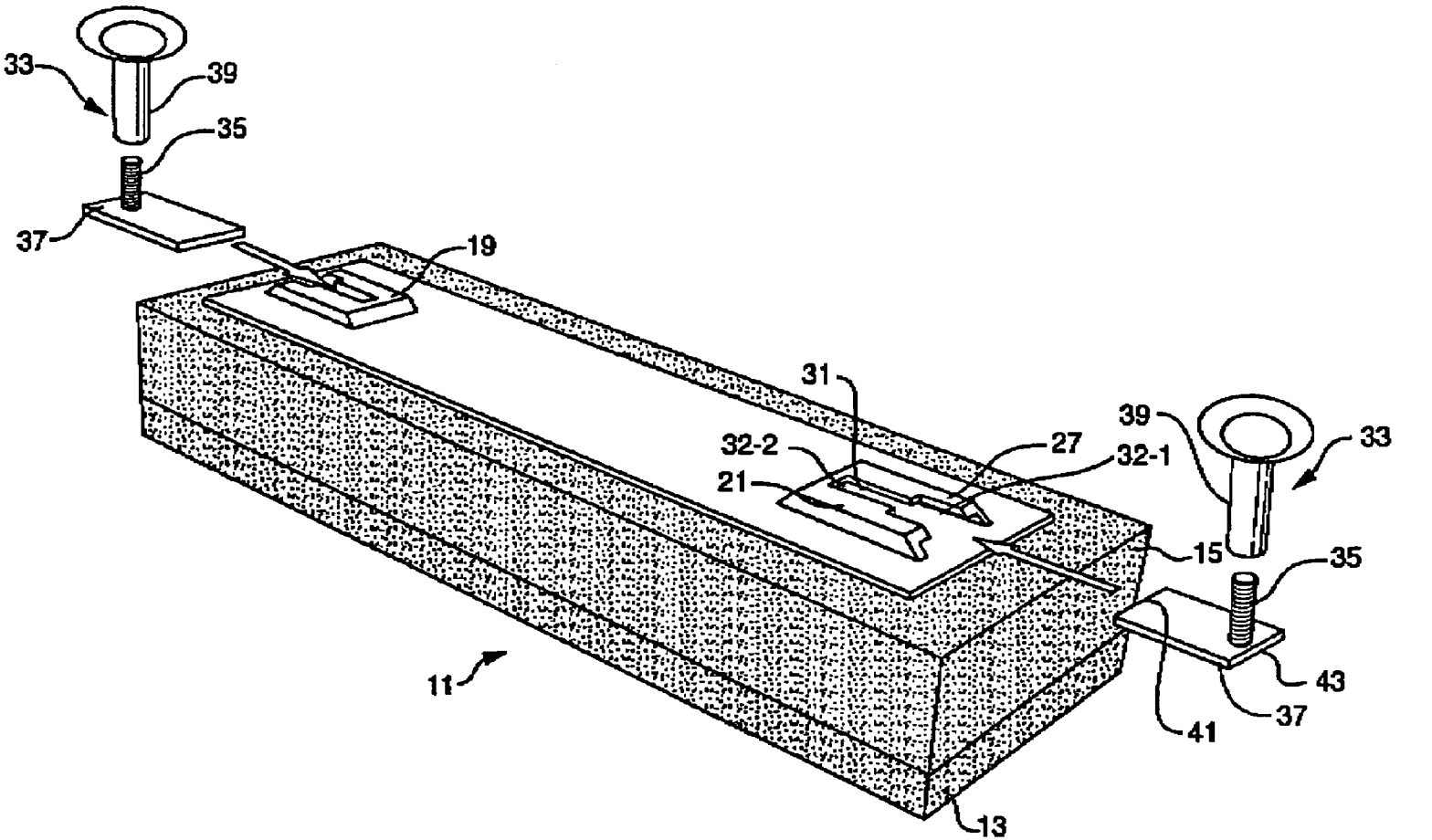
FIG. 3 is a perspective view partly exploded of the cleaning pad shown in FIG. 1.

Referring now to the drawings, there is shown in FIG. 1 a perspective view taken from the top of one embodiment of a disposable liquid absorbing cleaning pad according to this invention for use with a squeeze mop, the cleaning pad being identified by reference numeral 11. A perspective view of cleaning pad 11 taken from the bottom is shown in FIG. 2 and a partly exploded view of the cleaning pad 11 is shown in FIG. 3.

Cleaning pad 11, which is generally rectangularly shaped, includes a layer 13 of flexible open cell foam material made from melamine resin. A layer 15 of sponge material, such as polyester foam, is bonded to layer 13 by a suitable adhesive (not shown), such as glue. Examples of other material for layer 15 of sponge material are natural sponges, polyurethane foams, cellulose and absorbent arrays of synthetic fibers. The invention is not limited in this regard, and any appropriate sponge material known to those skilled in the art may be used in the cleaning pad.

The layer 13 of foam made from melamine resin may comprise between about 10% to about 80% of the total thickness of the cleaning pad 11. Preferably, the layer of foam made from melamine resin comprises between about 20% to about 60%, and more preferably between about 25% to about 50%, of the total thickness of the cleaning pad. In an especially preferred embodiment, the layer of foam made from melamine resin comprises about 30% of the total thickness of the cleaning pad.

A backing plate 17 for removably securing cleaning pad 11 to a squeeze mop is fixedly attached to the layer 15 of sponge material. Preferably, the backing plate 17 is fixedly attached to the layer 15 of sponge material using glue or by using heat to fuse the layer 15 of sponge material to the backing plate. In this embodiment, backing plate 17 is an elongated rectangularly shaped plate of plastic material having a length of about 8 ½ inches, a width of about 2 inches and a thickness of about 1/16 of an inch. The invention is not limited in this regard, and the backing plate may have any desired length, width and thickness. The length, width and thickness are selected to provide adequate support to the cleaning pad 11, and to attach the cleaning pad 11 to mop heads that will receive a backing plate having the selected dimensions. A pair of opposed pockets 19 and 21 are integrally formed on the top surface 23 of backing plate 17. Each pocket 19 and 21 includes a top wall 25 and 27, respectively, having a slot 29, 31, respectively. Each slot 29, 31 has an outer portion 32-1 and an inner portion 32-2, outer portion 32-1 being wider than inner portion 32-2.

Cleaning pad 11 further includes a pair of wing screw assemblies 33 for use in removably securing cleaning pad 11 to the head of a squeeze mop of the type which includes a pair of cleaning pad mounting holes. Each wing screw assembly 33 is slidably and removably mounted in one of the pockets 19 and 21. Each wing screw assembly 33 includes a screw 35 which is fixedly mounted off-center on a thin rectangularly shaped metal plate 37 which is slidably and removably mounted in one of the pockets 19 and 21 and a wing nut 39 which is removably screwed onto screw 35.

In use, screws 35 extend through a pair of cleaning pad mounting holes on the mounting plate of the squeeze mop and are then tightened using wings nuts 39 to removably attach backing plate 17 to the mounting plate of the squeeze mop.

As can be seen, screw assemblies 29 can be positioned at any location along slots 29 and 31 with either end 41 and 43, inserted first. As a result, cleaning pad 11 will accommodate a variety of different mounting hole spacings.

Figure 4:
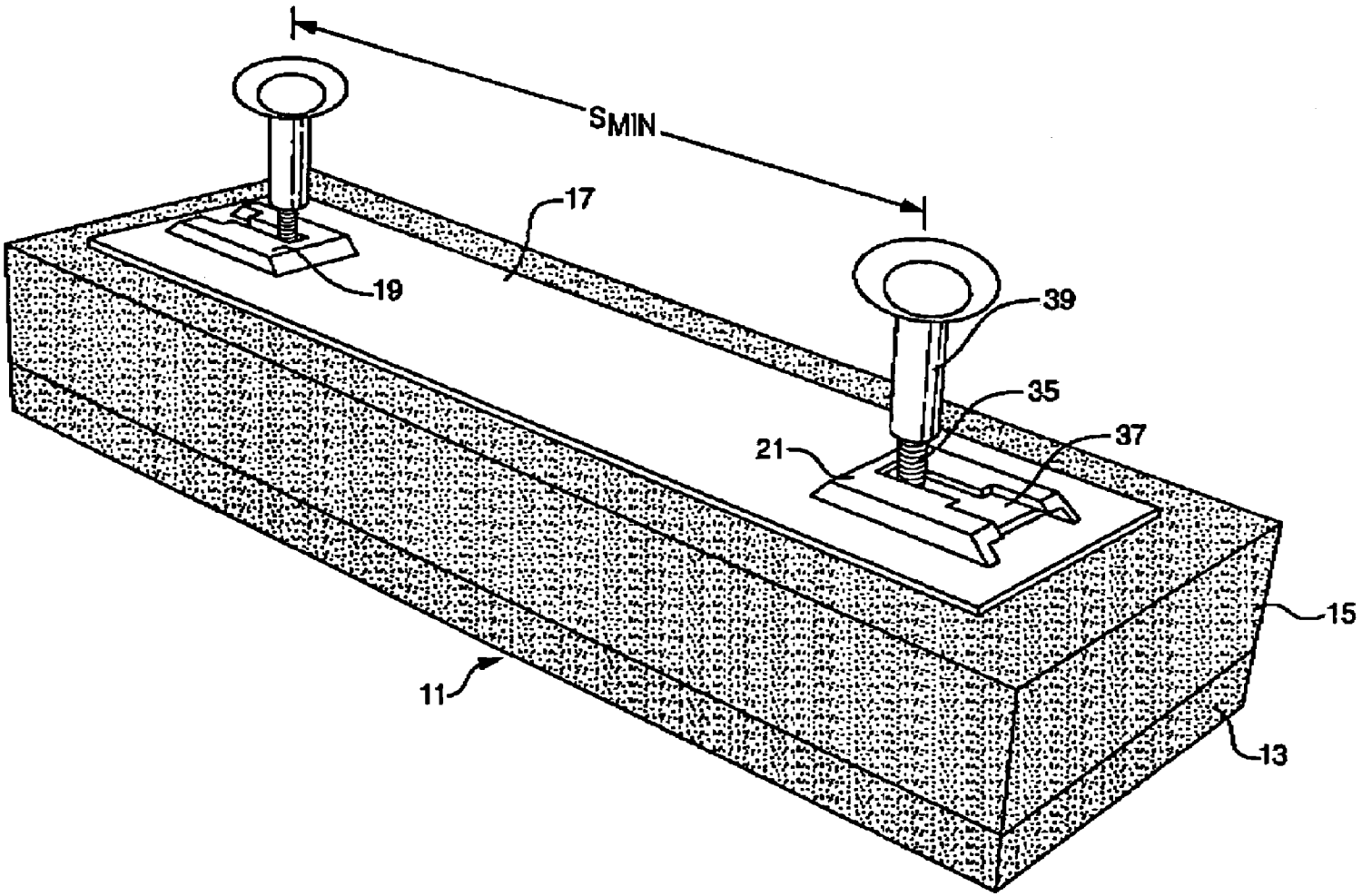
FIG. 4 is a top perspective view ofthe cleaning pad shown in FIG. 1 with the wing screw assemblies positioned in the pockets on the backing plate for minimum spacing.

FIG. 1 shows wing screw assemblies 33 positioned on backing plate 17 for maximum spacing (SMAX) and FIG. 4 shows wing screw assemblies 33 positioned on backing plate 17 for minimum spacing (SMIN).

The flexible open cell foam material made from melamine resin may be, for example, material manufactured by BASF corporation in Ludwigshaffen, German and sold under the name BASOTECT®. The length $L_1$, width $W_1$ and height $H_1$ of cleaning pad 11 may be any dimensions appropriate for use on a particular type of hand held cleaning implement. Although the invention is not intended to be limited by the dimensions of the cleaning pad, preferably the length $L_1$ is between about 8 inches and about 12 inches, the width $W_1$ is between about 2 inches and about 4 inches, and the height $H_1$ is between about 2 inches and about 4 inches. In a particularly preferred embodiment, $L_1$ is about 9 ½ inches, $W_1$ is about 3 inches and $H_1$ is about 1 ½ inches. In this preferred embodiment, the thickness T, of layer 13 may be for example about 7/16 of an inch. It should be noted, however, that these dimensions are by way of example only, and that layer 13 and pad 11 may have other dimensions.

Although flexible open cell foam material made from melamine resin had been used previously on small hand held cleaning sponges, the melamine resin layer on the hand held sponges tended to wear quickly. It was previously thought that the wear characteristics of the melamine resin rendered it unsatisfactory for use in an application such as a sponge mop to clean surfaces such as floors. The present inventors unexpectedly discovered that, when used in a two layer cleaning pad as described herein, a flexible open foam material made from melamine resin can be used on a sponge mop, and provides improved cleaning of surfaces with satisfactory wear characteristics.

To use pad 11, after it is attached to a hand held cleaning implement, layer 13 is wet with water or other liquid, such as a soap solution or other cleaning solution.

Preferably, in assembling pad 11, backing plate 17 is first attached to sponge layer 15. Then, foam layer 13 is bonded to sponge layer 15.

Cleaning pad 11 can be used either as part of a new squeeze mop or as a refill for an existing squeeze mop.

Figure 5:
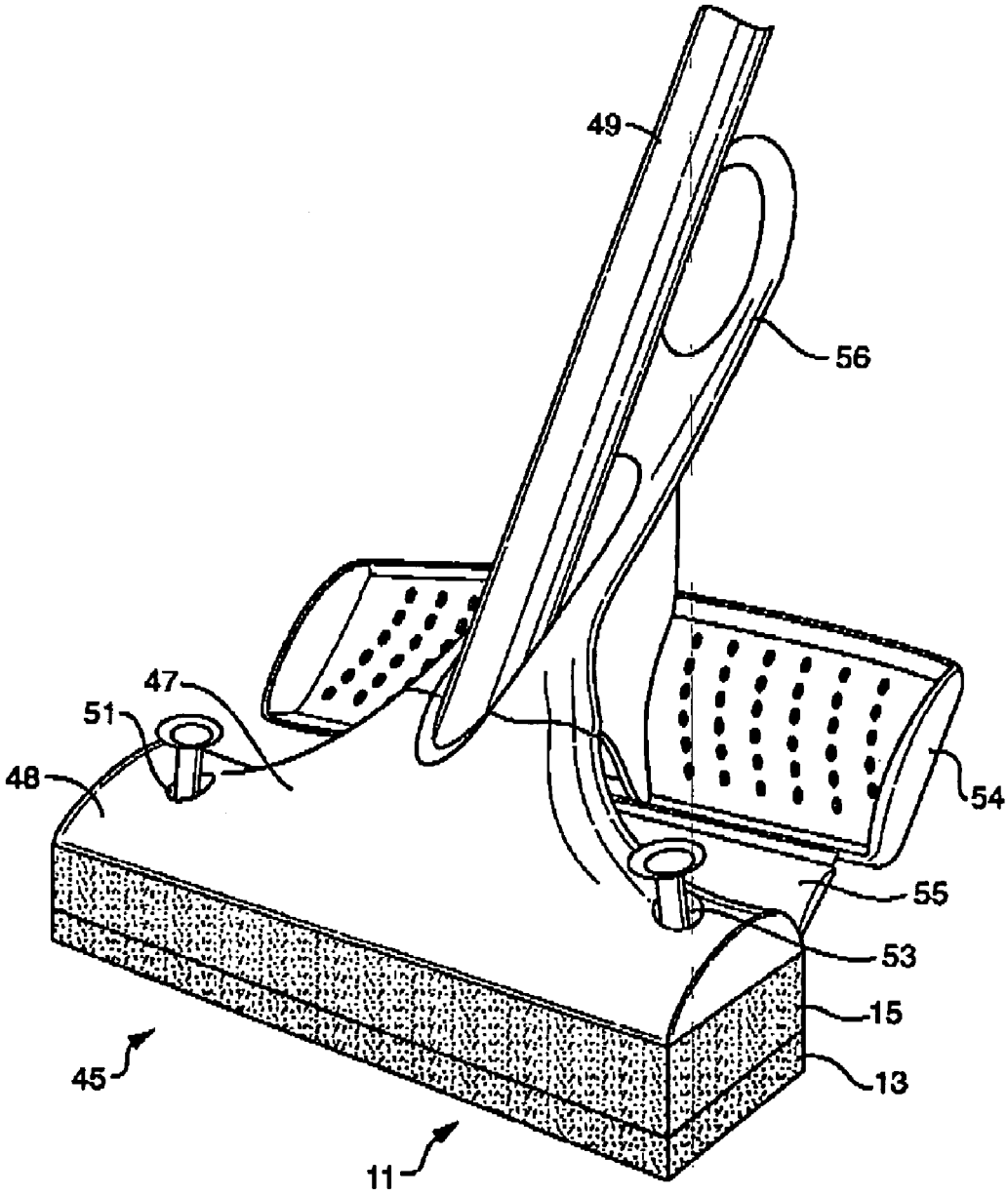
FIG. 5 is a fragmentary perspective view of a squeeze mop constructed according to this invention using the cleaning pad shown in FIG. 1.

FIG. 5 illustrates one type of a squeeze mop 45 constructed according to this invention using cleaning pad 11.

Squeeze mop 45 includes a mop head 47, a mounting plate 48 integrally formed with mop head 47, a mop handle 49 removably attached to mop head 47, a cleaning pad 11 removably attached to mounting plate 48 by wing screw assemblies 33 on backing plate 23 of cleaning pad 11 which extend through mounting holes 51 and 53 in mounting plate 48, a squeeze plate 54 attached by a living hinge 55 to mounting plate 48 and a squeeze plate handle 56 fixedly attached to squeeze plate 54.

Figure 6:
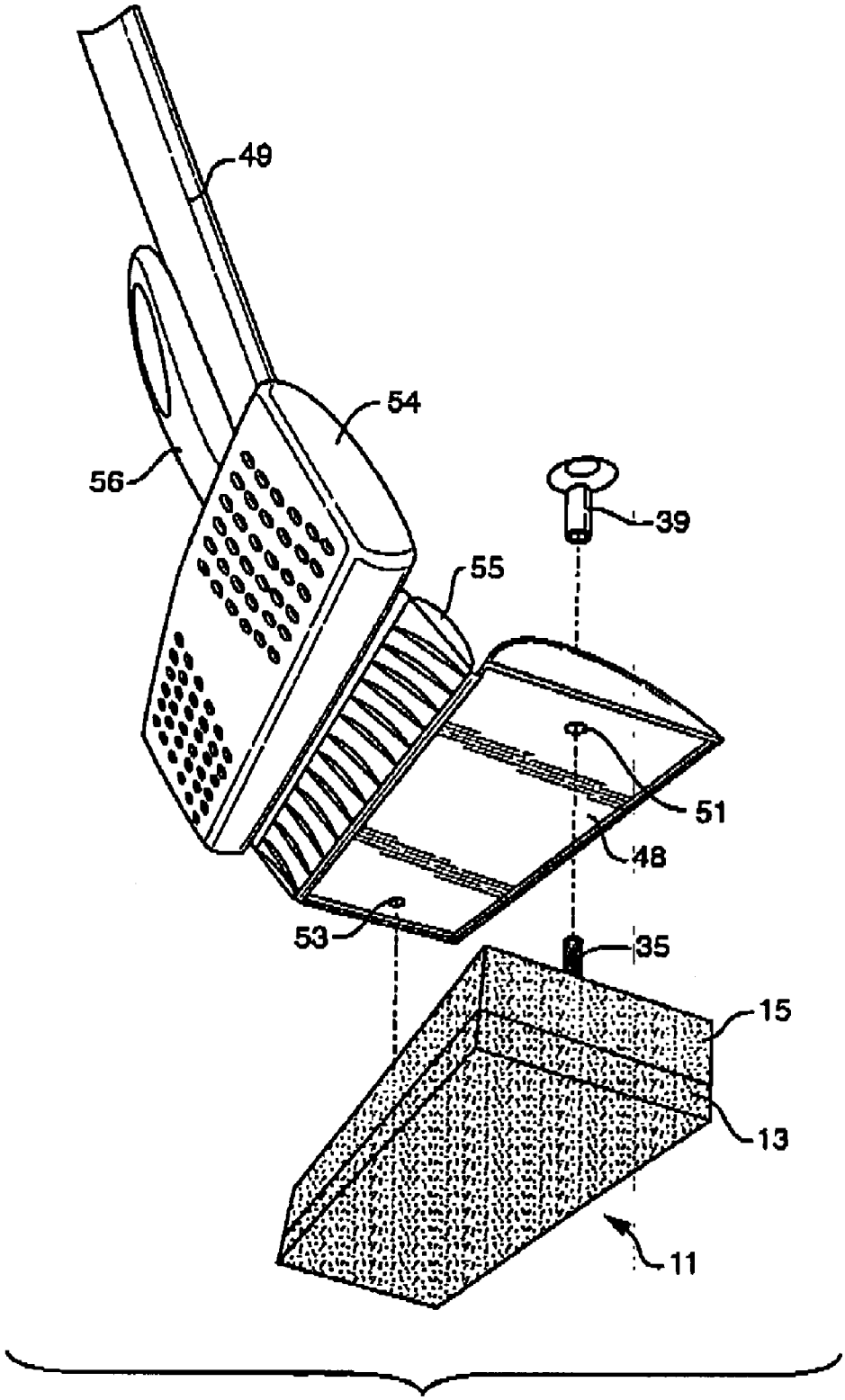
FIG. 6 is a fragmentary perspective view taken from the bottom and partially exploded of the mop shown in FIG. 5.

An exploded view of squeeze mop 45 taken from the bottom is shown in FIG. 6. Mop 45 is used in a conventional manner to clean surfaces such as floors.

Another well known type of squeeze mop comprises a mounting plate having a pair of tabs rather than a pair of mounting holes. Cleaning pad 11 can be used with this latter type of squeeze mop by simply removing the wing screw assemblies 33 and then inserting the tabs of the mounting plate into the slots in pockets 19 and 21.

Figure 7:
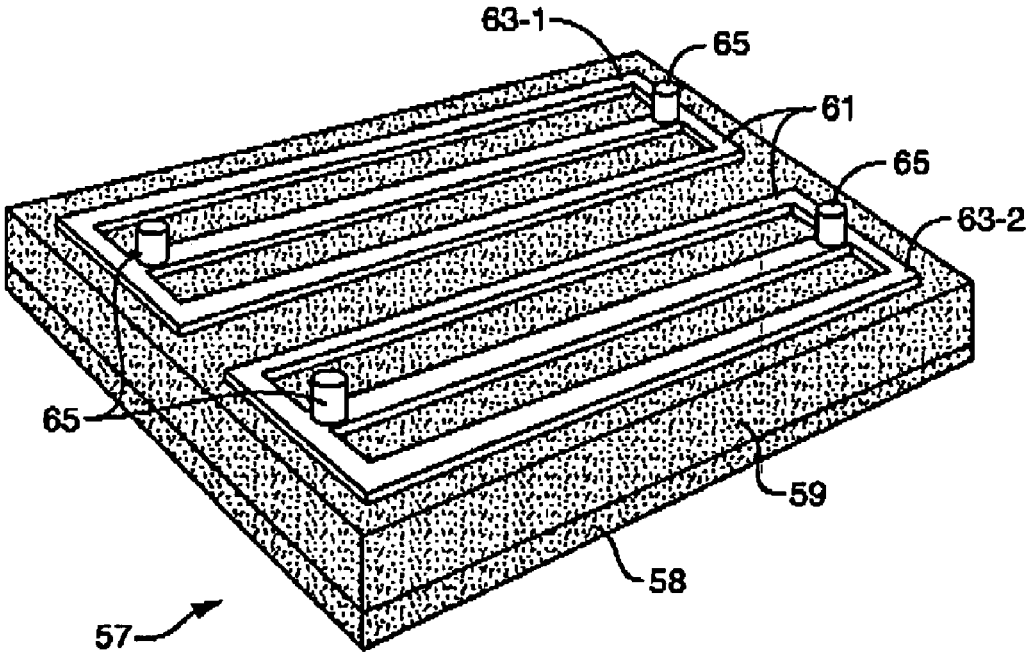
FIG. 7 is a perspective view of another embodiment of a cleaning pad for a squeeze mop constructed according to this invention.

In FIG. 7 is shown a perspective view of another embodiment of a cleaning pad for use with still another type of squeeze mop constructed according to this invention and identified by reference numeral 57.

Cleaning pad 57 includes a layer 58 of flexible open cell foam material made from melamine resin, a layer 59 of sponge material bonded to layer 58 and a backing plate 61 made up of frame sections 63-1 and 63-2 for removably securing pad 57 to a squeeze mop. Frame sections 63-1 and 63-2 are fixedly attached by a suitable adhesive (not shown) to layer 59. Backing plate 61 includes four pins 65 for removably attaching pad 57 by a press fit to the mounting plate and also to the squeeze plate of a squeeze mop. In a preferred embodiment, the length, width and height of pad 57 are about 8 inches by about 4 and 9/16 inches by about 1 and ½ inches respectively, and the thickness of layer 58 is about 7/16 of an inch. As described above, these dimensions are by way of example only, and layer 58 and pad 57 may have other dimensions. Cleaning pad 57 can be used either as a part of a new mop or as a refill for an existing mop.

Figure 7A:
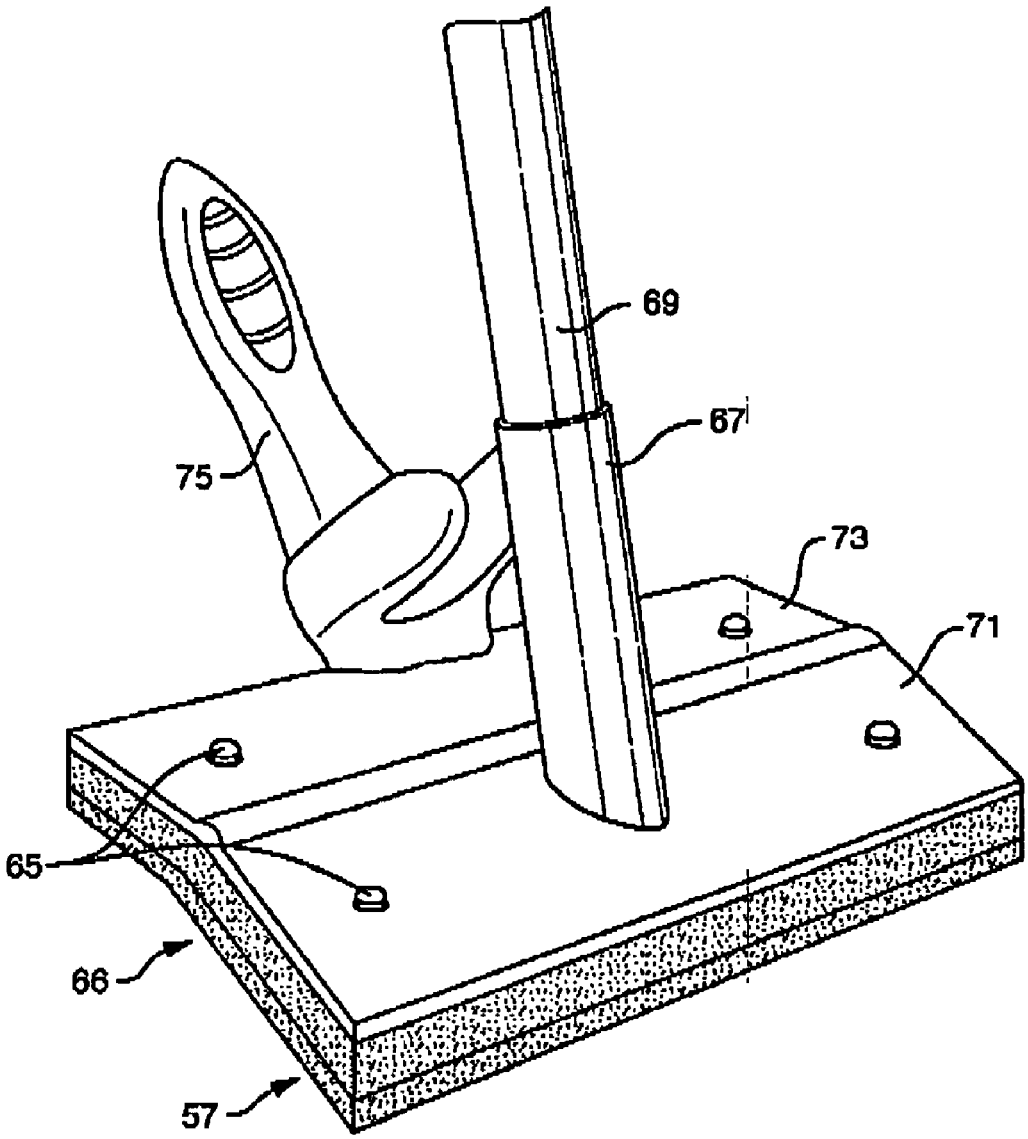
FIG. 7A is a fragmentary perspective view of a squeeze mop using the cleaning pad shown in FIG. 7.

In FIG. 7A is shown a fragmentary perspective view of squeeze mop constructed using cleaning pad 57 and identified by reference numeral 66.

Squeeze mop 66 includes a head 67, a handle 69 removably mounted on mop head 67 at one end thereof, a mounting plate 71 fixedly secured to head 67, a squeeze plate 73 hingedly connected to mounting plate 71, a squeeze plate handle 75 fixedly secured to squeeze plate 73, a cleaning pad 57, cleaning pad 57 including a backing plate 61 having a plurality of attachment pins 65, cleaning pad 57 being removably mounted on mounting plate 71 and also on squeeze plate 73. To assemble the mop, attachment pins 65 are pushed up through mounting holes 68 in mounting plate 71 and on squeeze plate 73 to removably secure cleaning pad 57 onto mounting plate 71 and on squeeze plate 73. As can be seen, the main differences between squeeze mop 45 and squeeze mop 66 are, in addition to the overall size of the cleaning pads, that in squeeze mop 45 cleaning pad 11 is removably mounted only on head 47 whereas in squeeze mop 66 cleaning pad 55 is removably mounted on mounting plate 71 and also on squeeze plate 73. Also, the attachment structure in mop 45 is wing screw assemblies 33 while in mop 66 the attachment structure is attachment pins 65.

Figure 8:
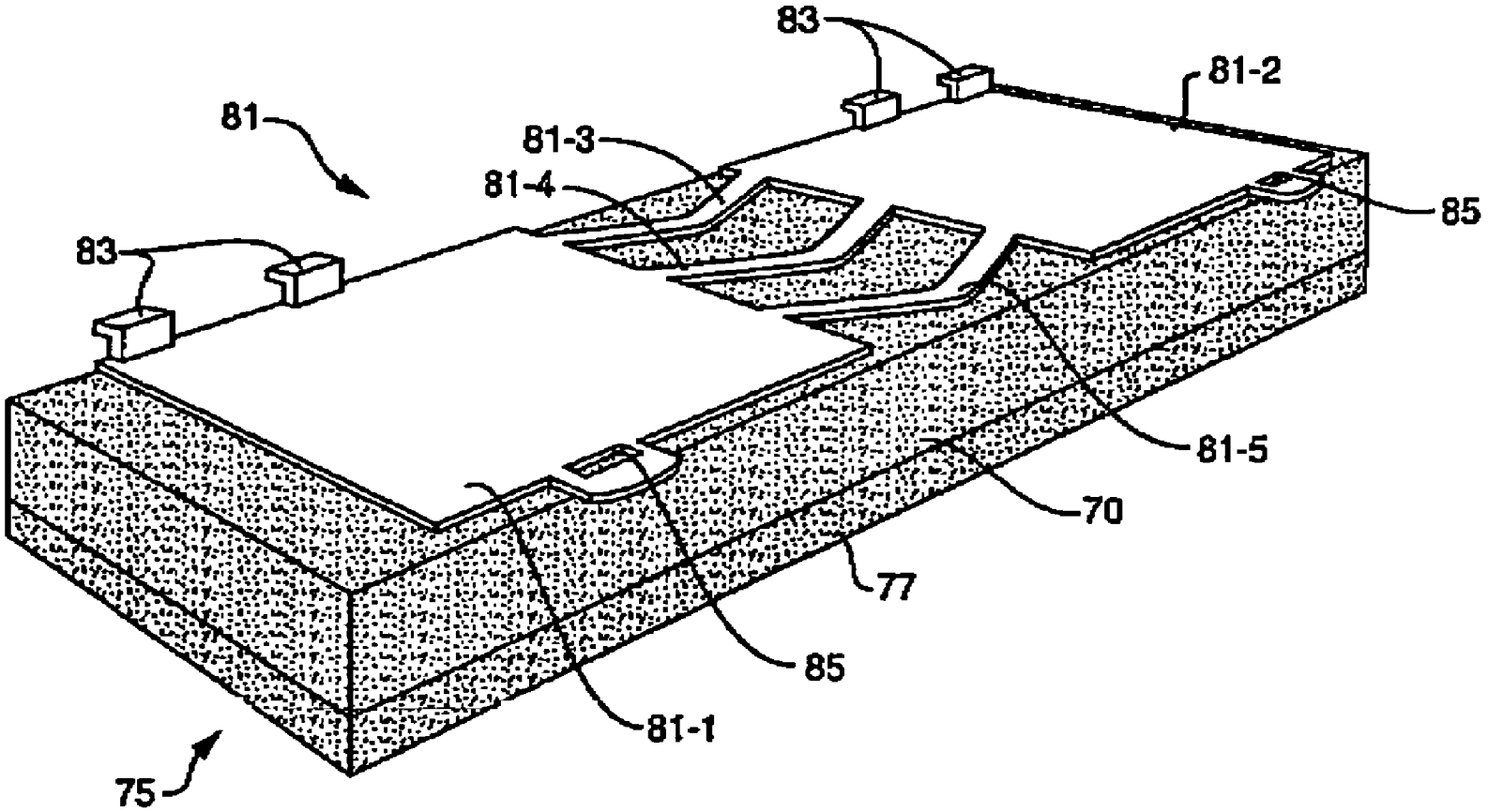
FIG. 8 is a perspective view of a cleaning pad constructed according to this invention for use on a butterfly mop.

In FIG. 8 is shown a perspective view of a cleaning pad constructed according to this invention for use on a butterfly mop, the cleaning pad being identified by reference numeral 76. Cleaning pad 76 includes a layer 77 of flexible open cell foam material made form melamine resin, a layer 79 of sponge material bonded to layer 77 by any suitable means (not shown) and a backing plate 81 made of plastic fixedly secured to sponge layer 79 by any suitable means such as by an adhesive or by heat fusing (not shown), backing plate 81 comprising a pair of plate sections 81-1 and 81-2 connected by a hinge portion made up of three strips 81-3, 81-4 and 81-5. Each section 81-1 and 81-2 includes two tabs 83 and one slot 85 for removably attaching backing plate 81 to a pair of hinged wing plates on the mop. Pad 76 can either be a part of a new mop or a refill for an existing mop.

Figure 9:
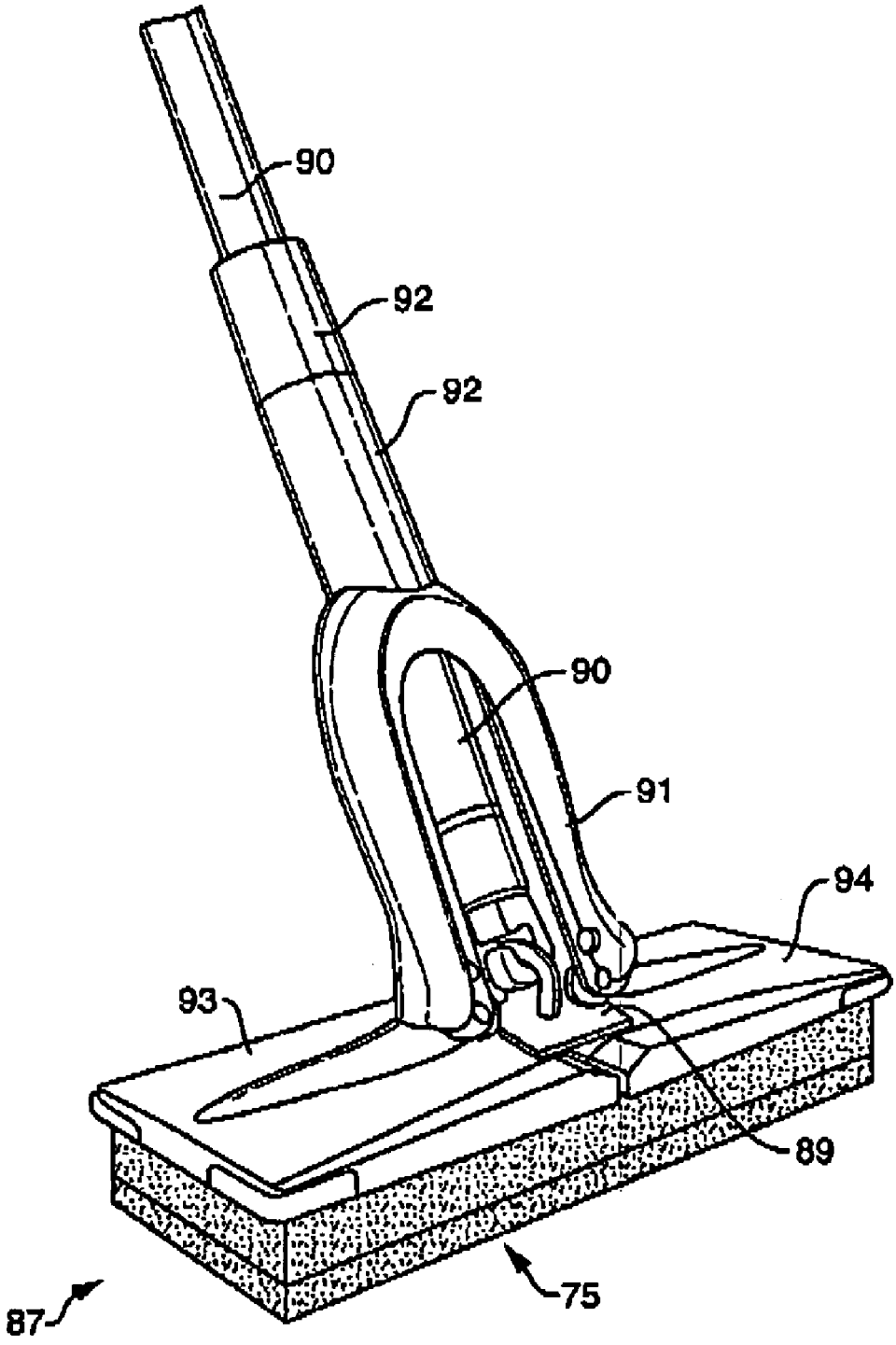
FIG. 9 is a fragmentary perspective view of a butterfly mop using the cleaning pad shown in FIG. 8.

In FIG. 9 is shown a fragmentary perspective view of butterfly mop constructed according to this invention and identified by reference numeral 87.

Butterfly mop 87 includes a head 89. An inner handle 90 is coupled to head 89. A yoke 91 is mounted on an outer handle 92. Inner handle 90 is movable within outer handle 92. A pair of hinged wing plates 93 and 94 are attached to head 89 and a cleaning pad 75 is removably mounted on wing plates 93 and 94. In use, outer handle 92 is pushed down with one hand while holding inner handle 90 with the other hand to cause wing plates 93 and 94 to fold to a closed position in order to extract liquid collected by cleaning pad 75.

It should be noted that instead of a cleaning pad which includes a backing plate as shown in FIGS. 1, 3, 7, and 8 which removably engages a mounting plate on the cleaning implement as shown in FIG. 5, 6 and 7A or the wing plates as shown in FIG. 9, a cleaning pad could be provided which includes a layer of Velcro material (either hooks or loops) which removably engages a mating Velcro construction (either hooks or loops) integrally formed on the head ofthe implement or attached to the head by any suitable means such as an adhesive.

Figure 10A:
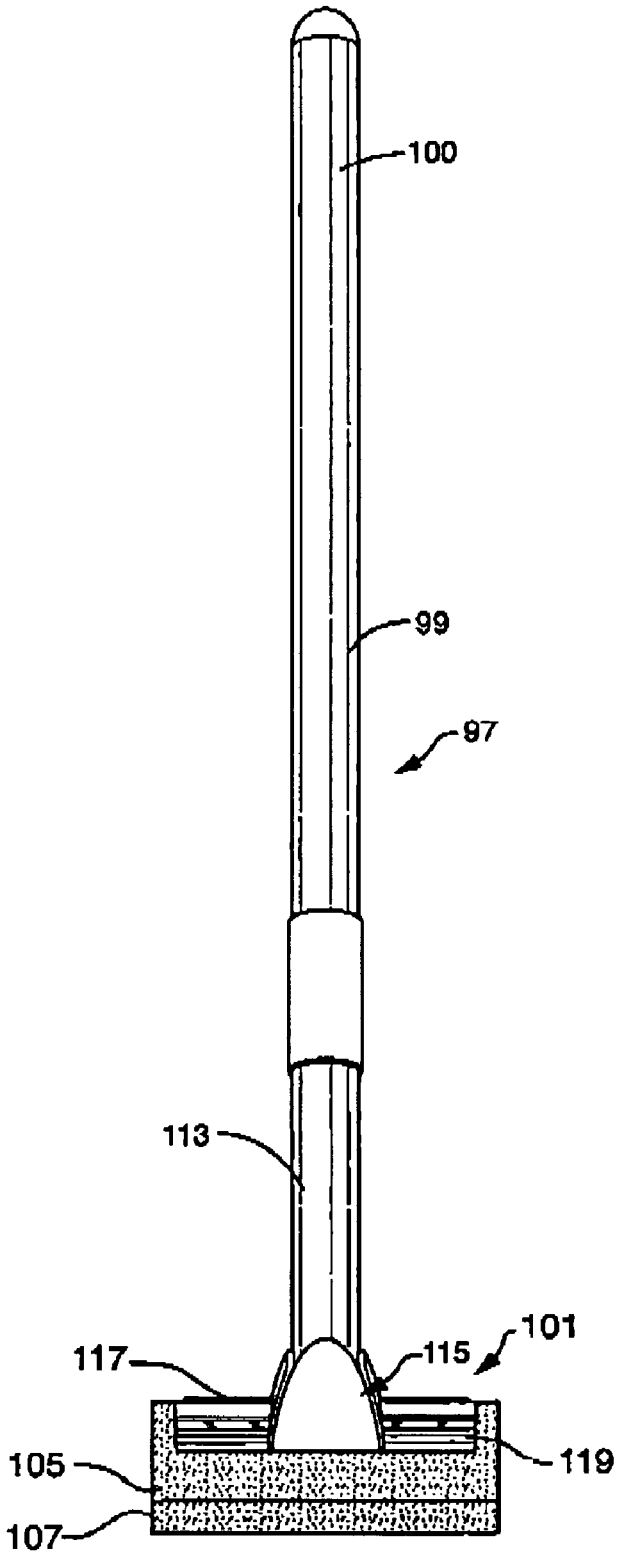
FIG. 10A is a perspective view from the front of a roller mop including a cleaning pad constructed according to this invention.
Figure 10B:
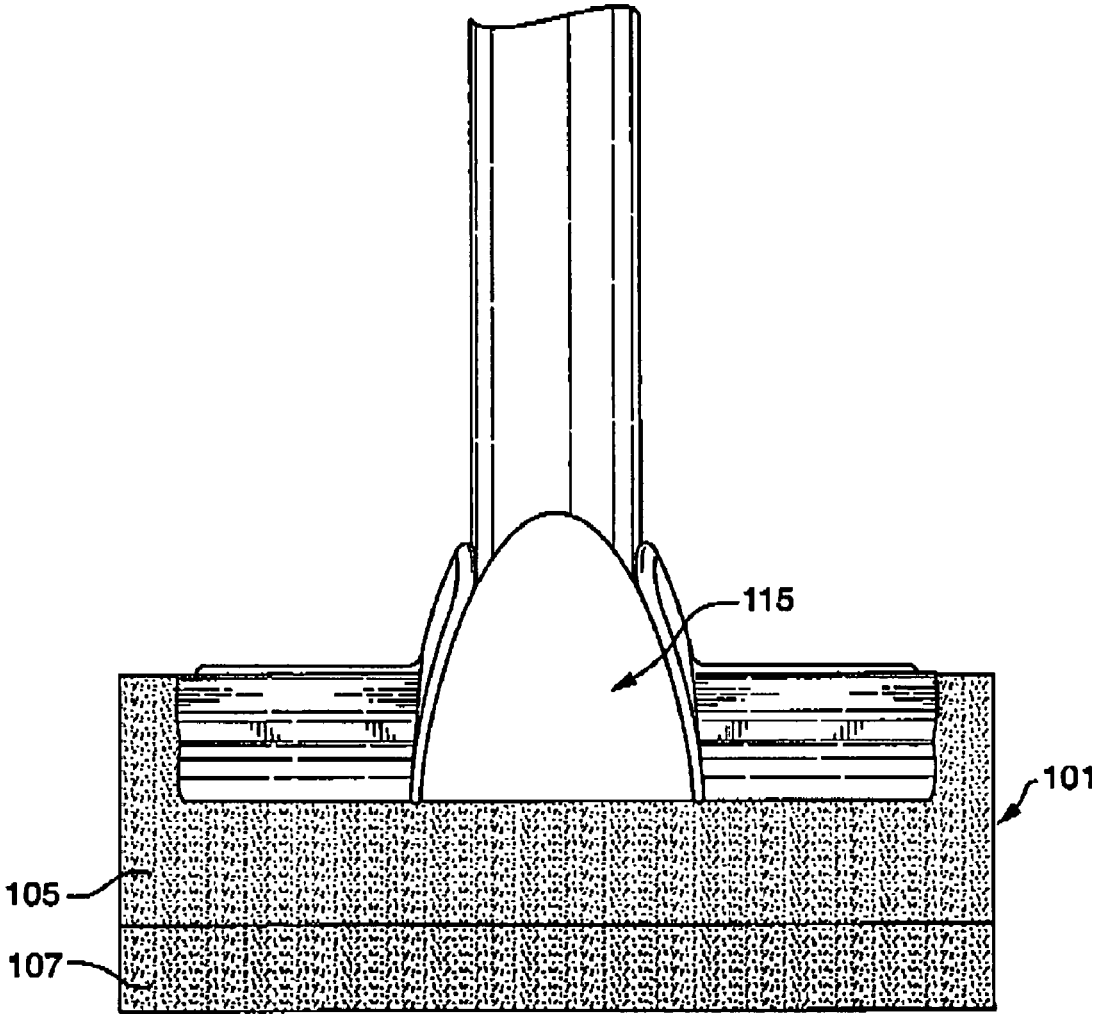
FIGS. 10B and 10C are perspective views from the front and side, respectively, of the bottom of the roller mop shown in FIG. 10.
Figure 10C:
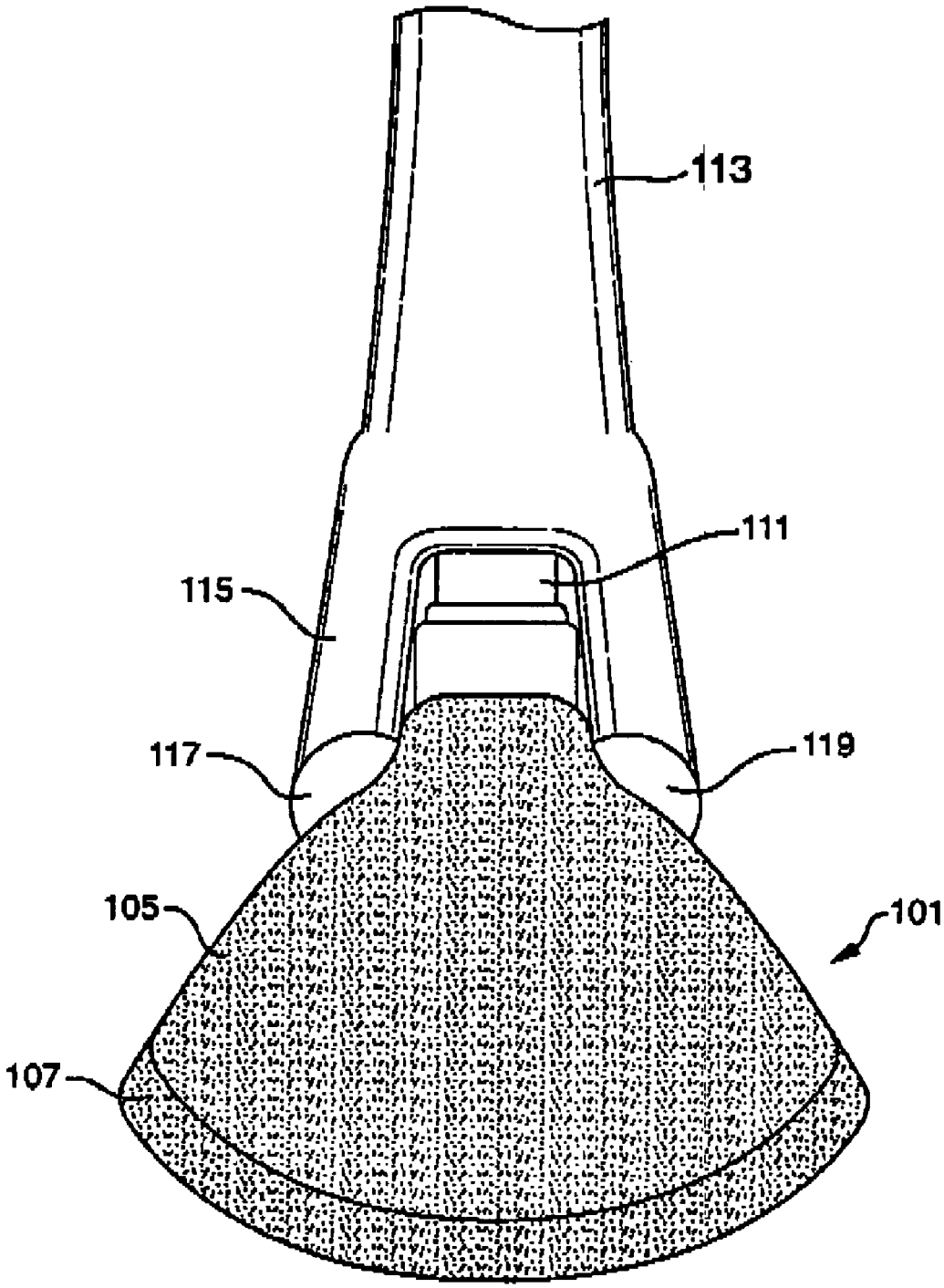
Figure 11:
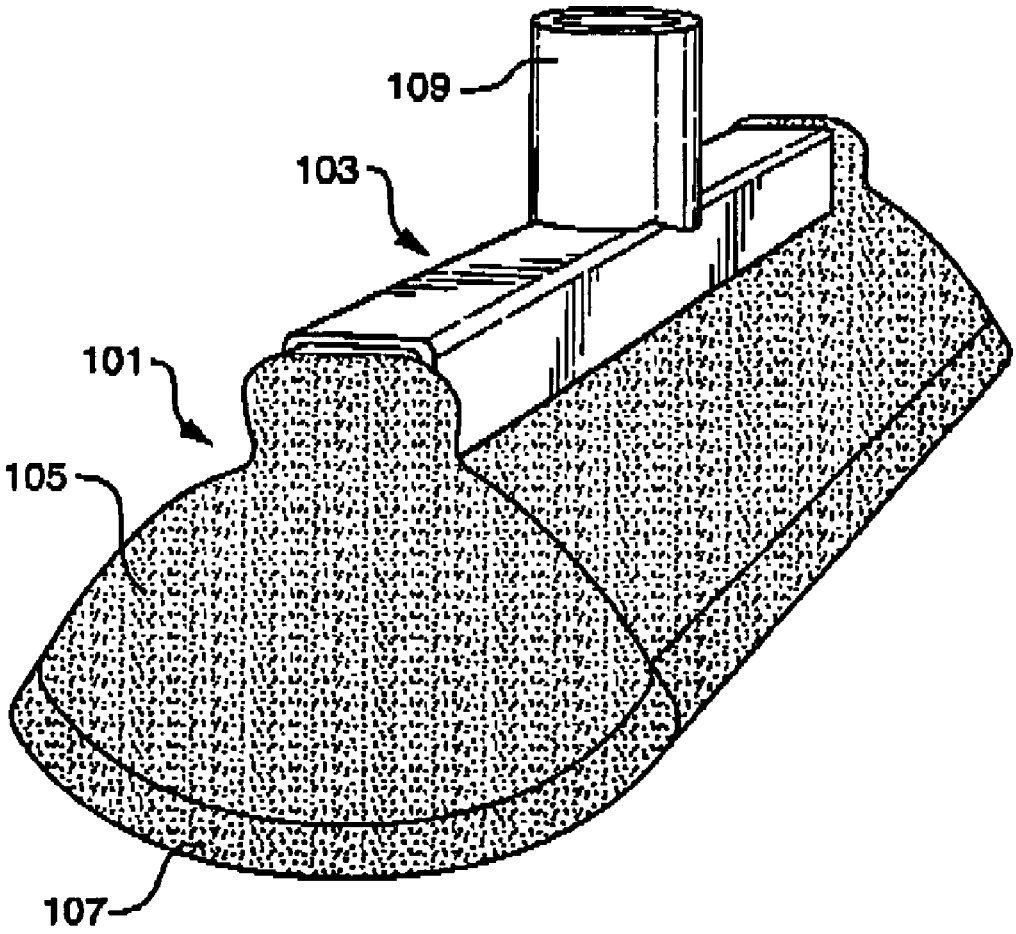
FIG. 11 is a perspective view of the cleaning pad in the roller mop shown in FIG. 10.

Referring now to FIG. 10A there is shown a perspective view from the front of one type of a roller mop having a cleaning pad constructed according to this invention, the roller mop being identified by reference numeral 97. Front and side perspective views of the bottom of mop 97 are shown in FIGS. 10B and 10C and a perspective view of the cleaning pad in mop 97 is shown in FIG. 13.

Roller mop 97 includes an elongated handle 99 having a handgrip 100 at the top and a disposable cleaning pad 101. Cleaning pad 101 includes an attachment structure 103, a layer of sponge material 105 fixedly attached to attachment structure 103 and a layer of open cell foam material made from melamine resin 107 fixedly attached to layer 105. In this embodiment, attachment structure 103 includes an internally threaded tubular portion 109 which is screwed into the lower end 111 of handle 99 which is externally threaded. A sleeve 113 is slidably mounted on handle 99. Sleeve 113 includes a bifurcated lower end 115 on which are rotably mounted a pair of rollers 117 and 119. To wring out roller mop 97, sleeve 113 is pushed down relative to handle 99 causing rollers 117 and 119 to move down over sponge layer 105 and then melamine layer 107. It should be noted that the details of how roller mop 97 operates are well known and not a part of this invention.

The layer 107 of foam made from melamine resin may comprise between about 10% to about 80% of the total thickness of the cleaning pad 101. Preferably, the layer of foam made from melamine resin comprises between about 20% to about 60%, and more preferably between about 25% to about 50%, of the total thickness of the cleaning pad. In an especially preferred embodiment, the layer of foam made from melamine resin comprises about 30% of the total thickness of the cleaning pad.

Cleaning pad 101 can be used either as part of an original mop or as a refill for an existing mop.

In another well known type of roller mop (not shown) the cleaning pad is removably attached by attachment structure to a crank which is pivotally mounted on an elongated handle. An example of this may be found in U.S. Pat. No. 3,727,259, which patent is incorporated herein by reference.

Figure 12:
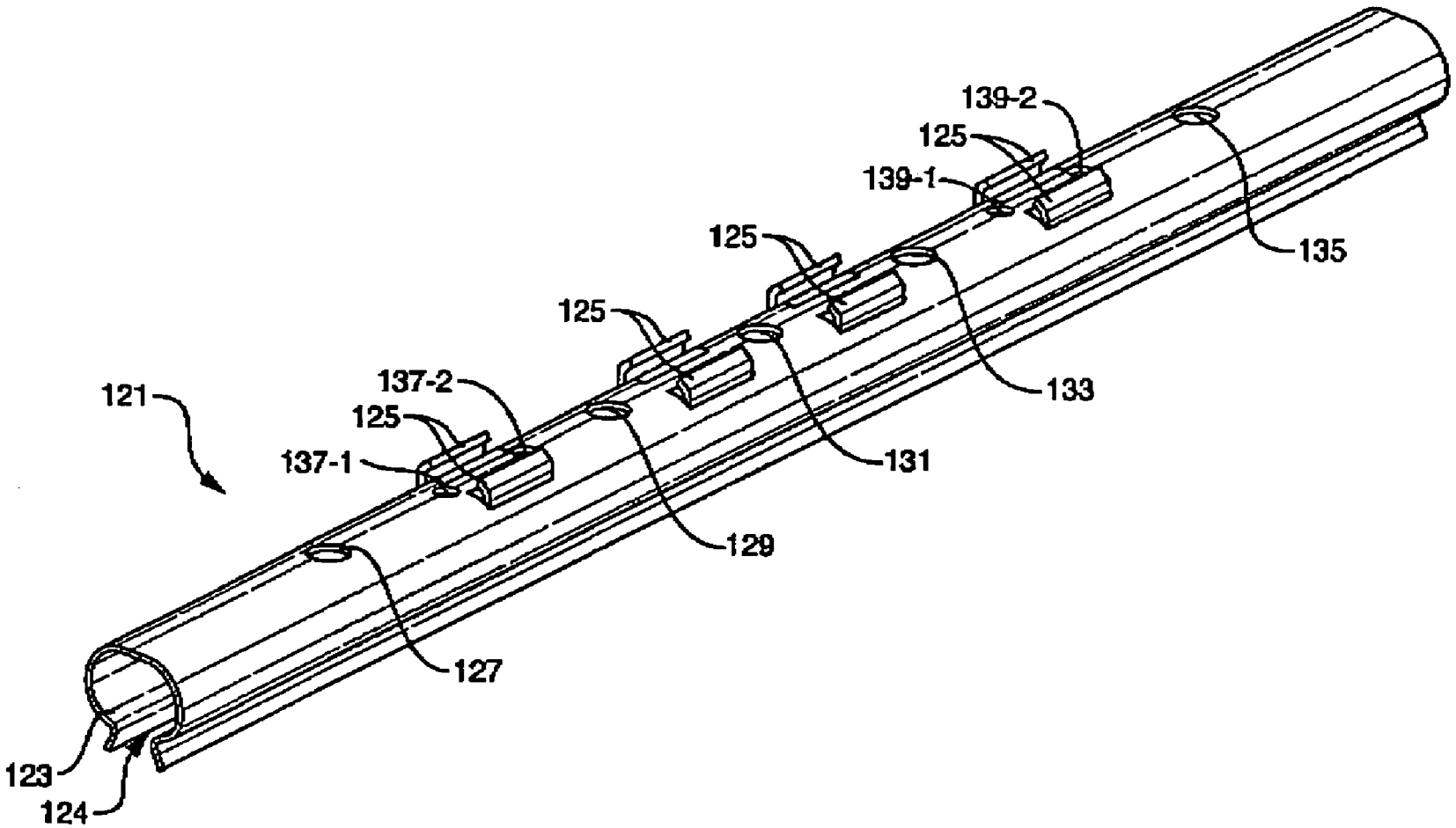
FIG. 12 is a perspective view of an attachment structure for use on a variety of roller mop heads.

An attachment structure 121 for a roller mop which is adaptable for use with a variety of roller mop heads is shown in FIG. 12. The attachment structure 121 is preferably an elongated hollow tubular structure with an opening 124 on one side and an internal channel 123 which is used to fixedly attach the disposable cleaning pad (not shown) to the attachment structure. The disposable cleaning pad may be fixedly attached to the attachment structure using any appropriate means known to those skilled in the art. Preferably, the cleaning pad is fixedly attached to the attachment structure using one or more of: (1) an adhesive, such as glue, (2) by compressing a portion of the sponge material on the cleaning pad within the channel, or (3) by providing the channel with serrated teeth to hold the cleaning pad within the channel. The attachment structure may be used with a cleaning pad of the type described above having a layer of sponge material and a layer of open cell foam material made from melamine resin, or it may be used with a cleaning pad comprising only sponge material.

The attachment structure may be made from any appropriate material used to hold disposable cleaning pads. Preferably, the attachment structure is made from plastic. The attachment structure 121 includes various means for attachment to a roller mop head, including a plurality of slotted tabs 125 for receiving devices for attachment to a handle, such as a roller mop handle, such as for example a metal rod. The attachment structure 121 also comprises a plurality of spaced threaded openings 127, 129, 131, 133, 135, 137-1, 137-2, 139-1, 139-2 for receiving various screw type devices for attachment to a handle, such as a roller mop handle.

Figure 13A:
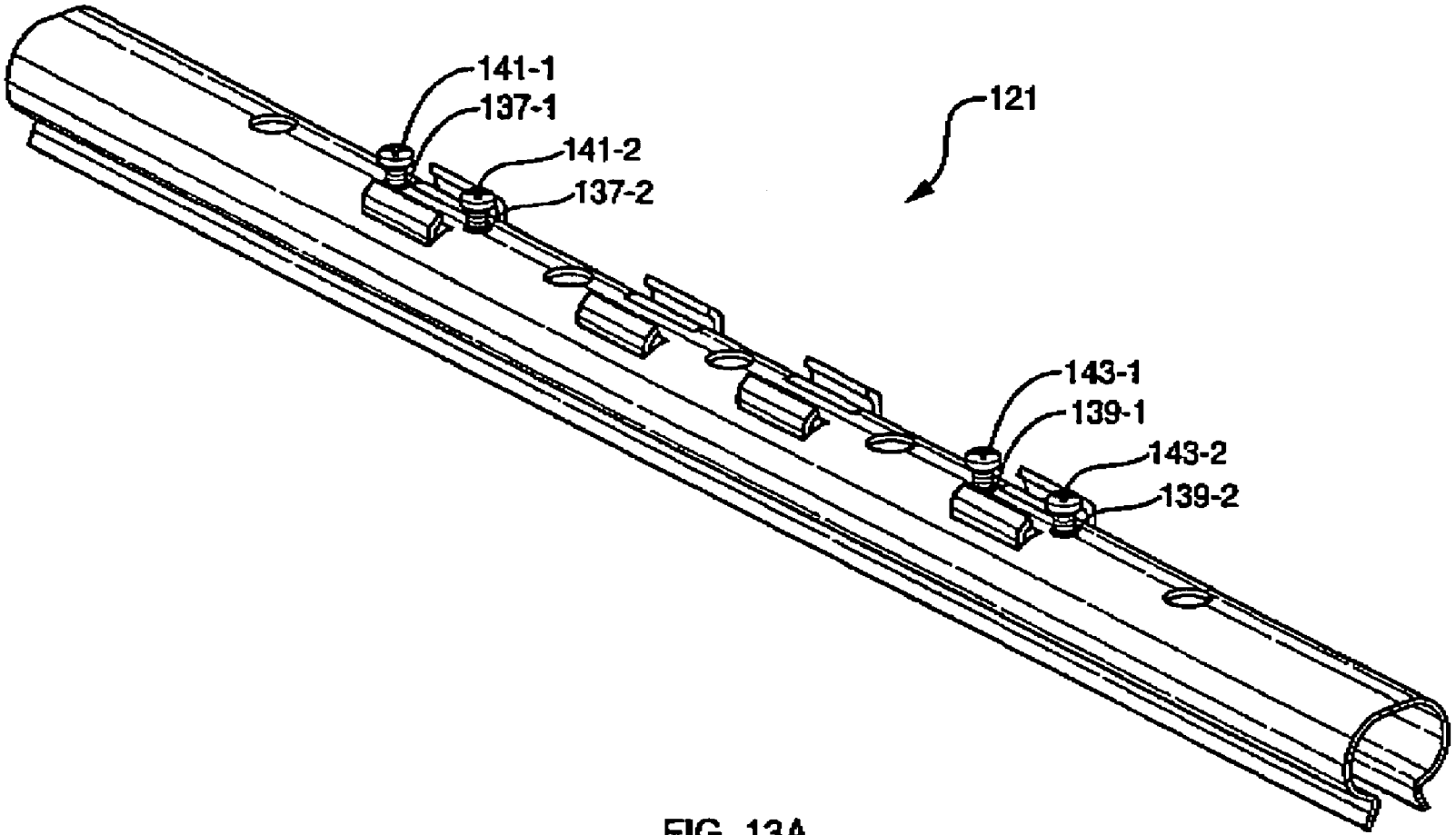
FIG. 13A is a perspective view of the attachment structure of FIG. 12 with a first type of mop head attachment screws.

In the embodiment of the invention shown in FIG. 12, the plurality of spaced threaded openings may be used to fix the attachment structure 121 to roller mop heads having various spaced openings for attaching cleaning pads using threaded fasteners. For example, as shown in FIG. 13A, in one embodiment, threaded screws 141-1, 141-2, 143-1 and 143-2 are received in corresponding threaded openings 137-1, 137-2, 139-1 and 139-2 on the attachment structure 121. In use, the screws 141-1, 141-2, 143-1 and 143-2 pass through corresponding openings on a roller mop head (not shown) to fixedly secure the mop head to the attachment structure with the cleaning pad.

Figure 13B:
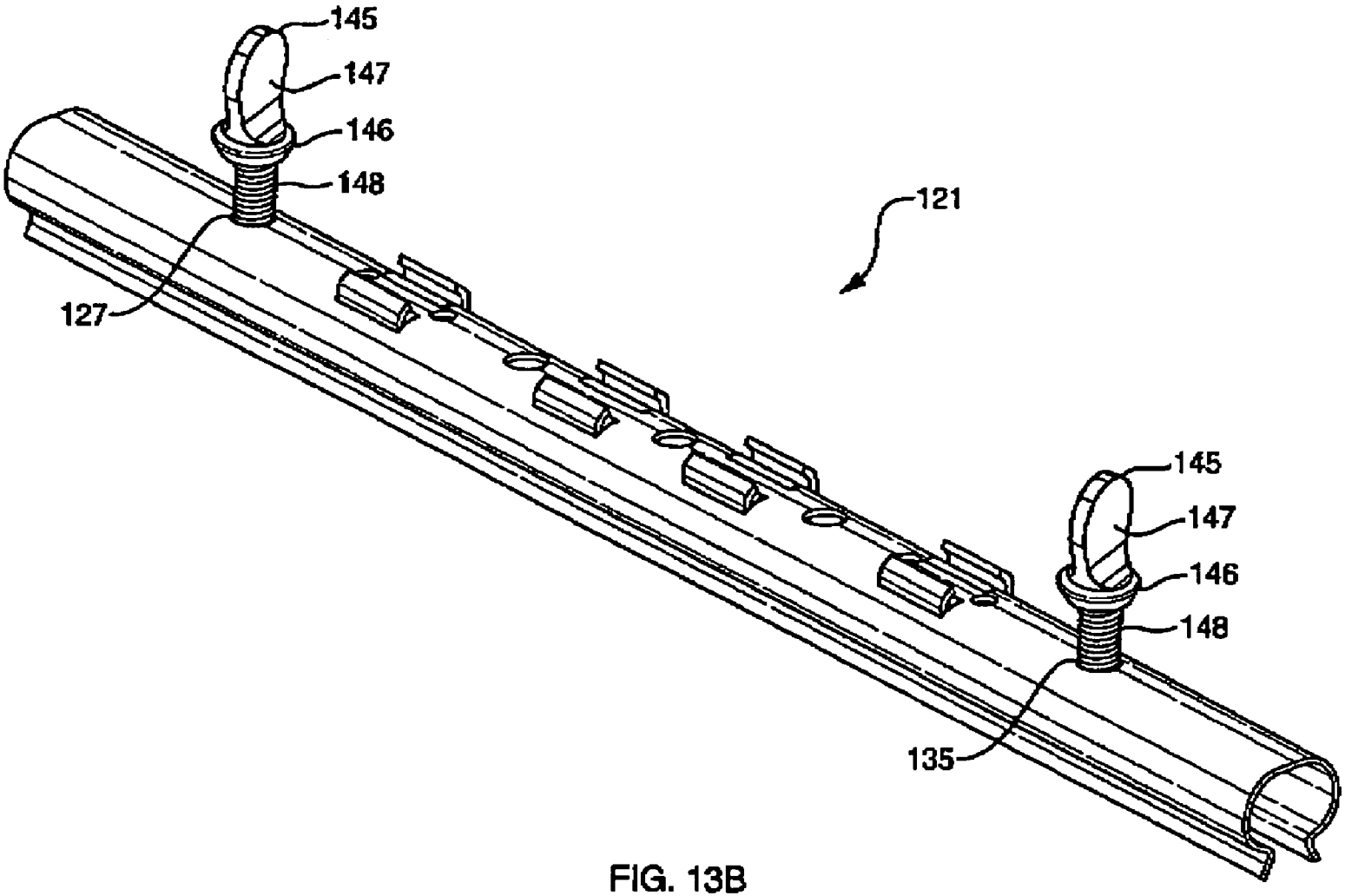
FIG. 13B is a perspective view of the attachment structure of FIG. 12 with a second type of mop head attachment screws.

In another embodiment shown in FIG. 13B, threaded screws 145 are received in corresponding threaded openings 127, 135 on the attachment structure 121. In this embodiment, the threaded screws 145 each include a threaded portion 148, a flattened upper portions 147 for gripping with thumb and forefinger, or with pliers or another gripping device, to turn the screws, and a skirt portion 146. In use, the threaded portion 148 of the screws pass through corresponding openings on a roller mop head and handle (not shown) and the skirt portion 146 engages a surface of the mop head. The threaded portions 148 are fixedly secured to the attachment structure to attach the mop head to the attachment structure with the disposable cleaning pad.

Figure 13C:
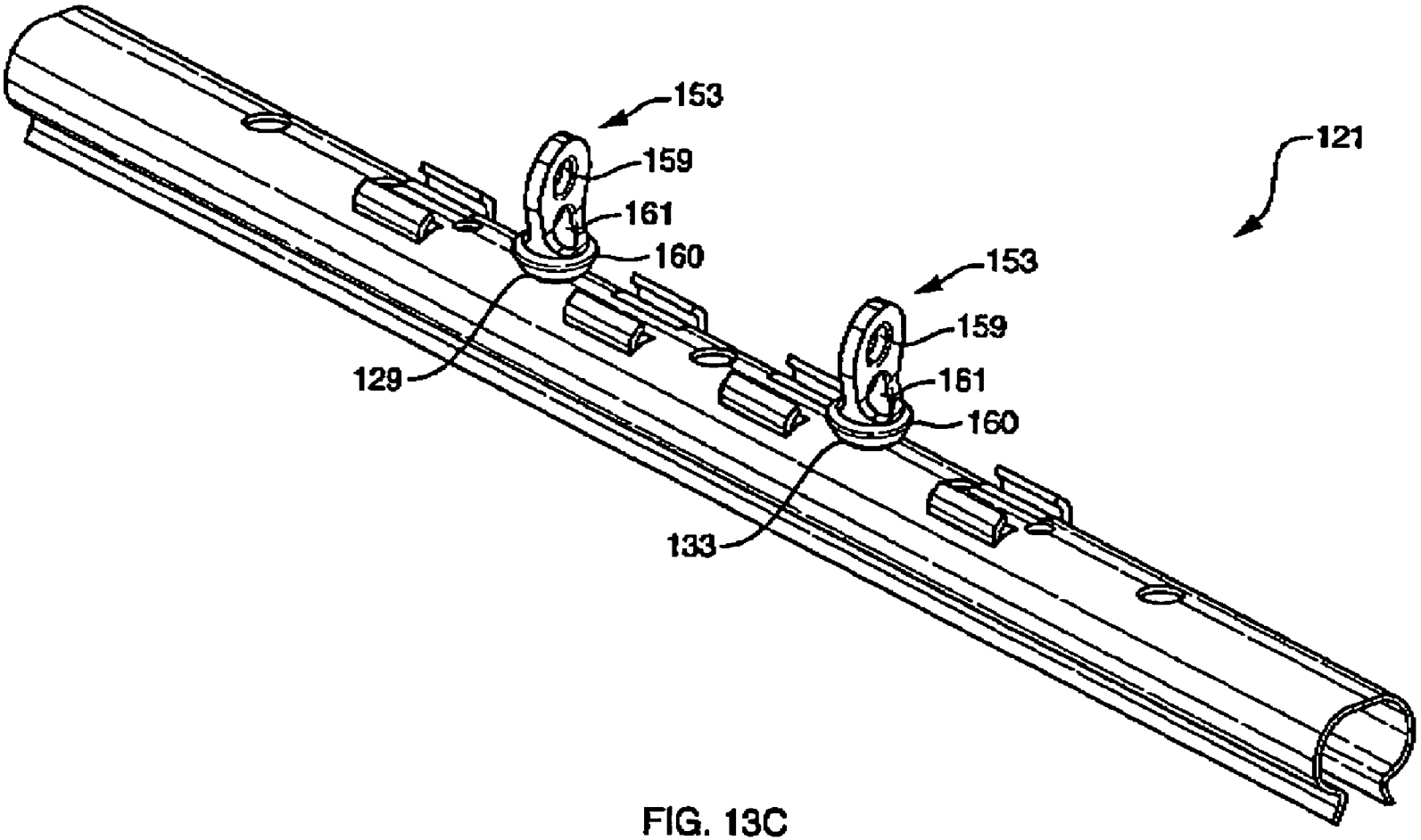
FIG. 13C is a perspective view of the attachment structure of FIG. 12 with mop head attachment screw devices.
Figure 13D:
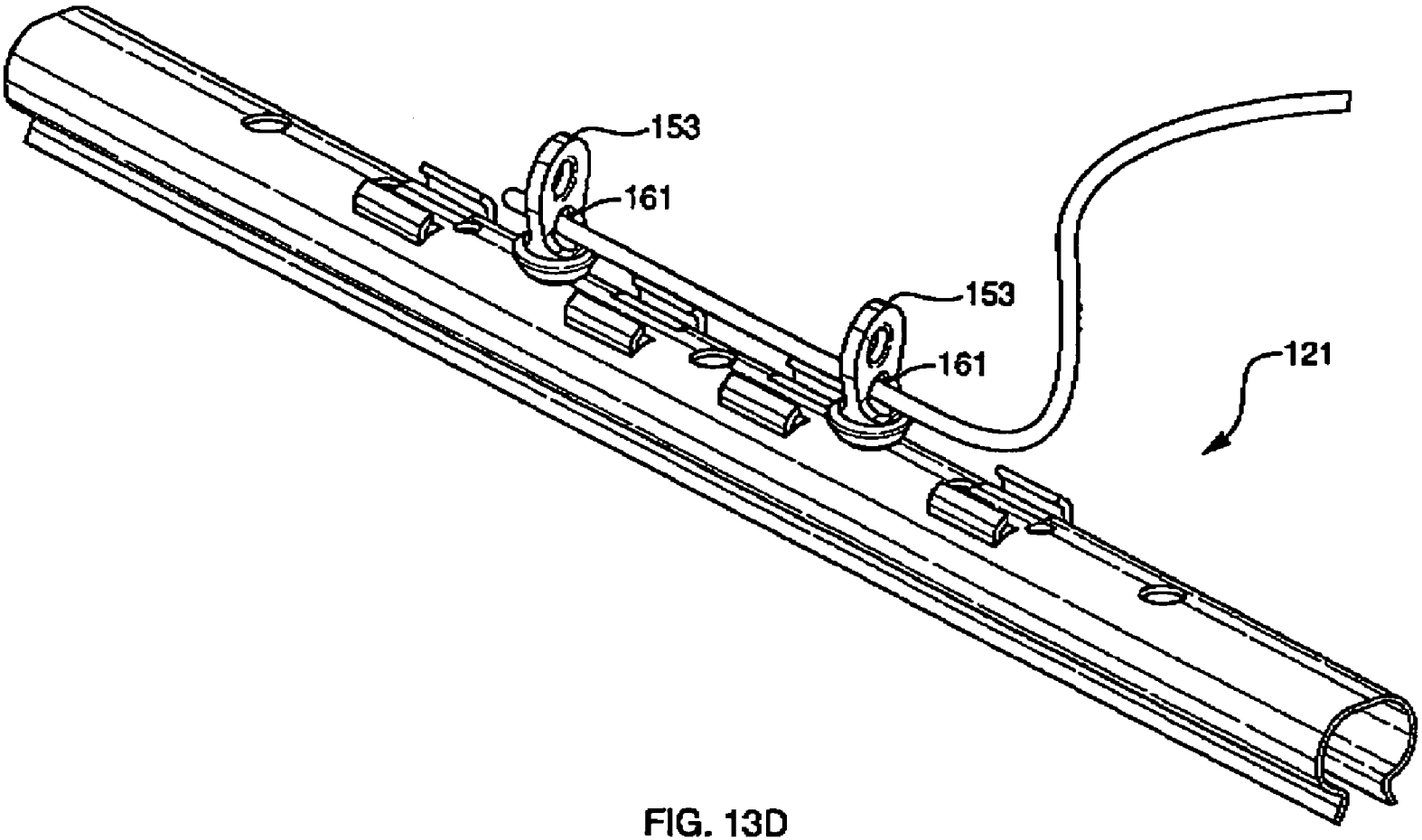
FIG. 13D is a perspective view of the attachment structure of FIG. 13C with an attachment rod inserted through the attachment screw devices.
Figure 14B:
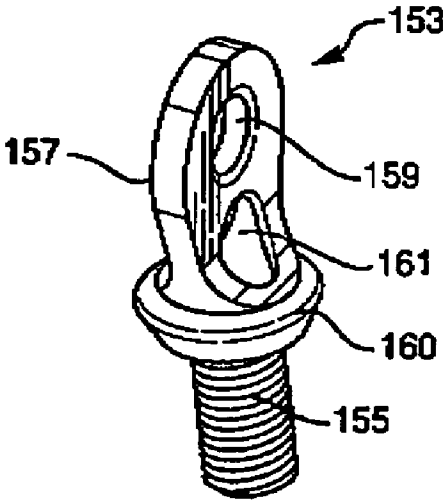
FIG. 14B is a perspective view of the attachment screw device of FIG. 14A.
Figure 14A:
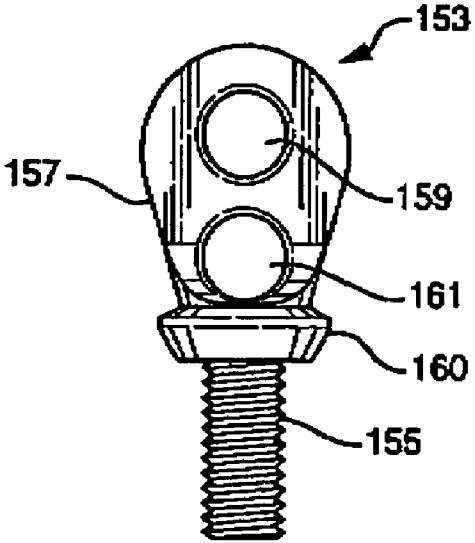
FIG. 14A is a front view of an attachment screw device.

FIGS. 14A and 14B shows an embodiment of a type of screw device for use with the attachment structure. As shown in FIG. 13C, in this embodiment, two screw devices 153 are received in corresponding threaded openings 129, 133 in the attachment structure 121. The screw device 153 comprises a threaded portion 155, a skirt portion 160 and an upper portion 157. The upper portion 157 is preferably flattened for gripping by thumb and forefinger to turn the screw. The upper portion has two holes 159, 161. The holes 159, 161 are sized to each receive rods that are attached to a roller mop handle. The screw device 153 can receive either a single rod or two rods, with each rod passing through corresponding holes in each screw device. As shown in FIG. 13D, a rod is passed through hole 161 in each of the screw devices. The rod 163 is attached to a roller mop handle (not shown) to attach the mop handle to the attachment structure 121.

Figure 13E:
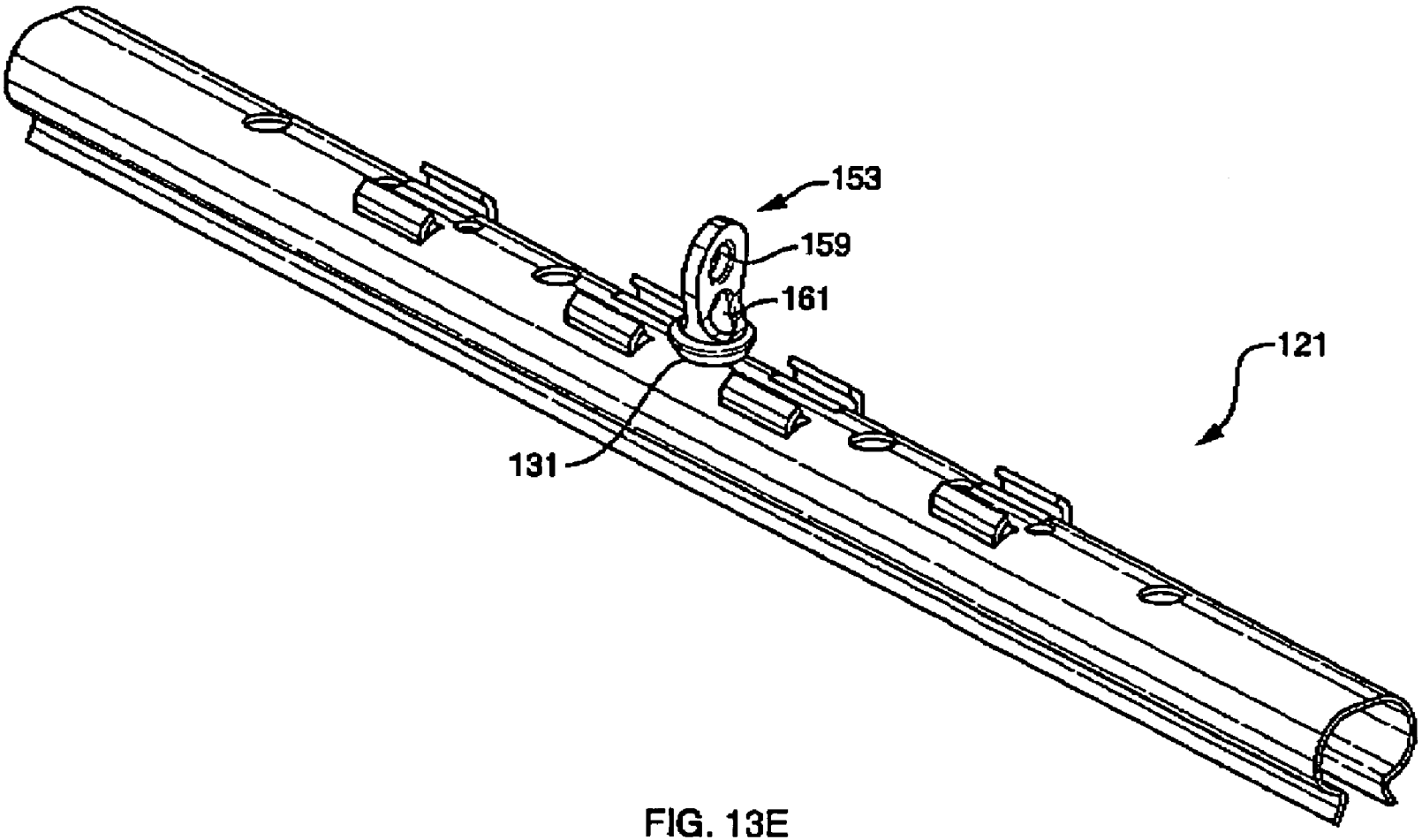
FIG. 13E is a perspective view of the attachment structure of FIG. 12 with a mop head attachment screw device.

In yet another embodiment shown in FIG. 13E, one screw device 153 is received in a corresponding threaded opening 131 in the attachment structure 121. In this embodiment of the invention, the attachment structure 121 is attached to the handle of the roller mop by means of a rod or other attachment means that passes through one or both of the holes 159, 161 in the screw device 153.

Figure 15B:
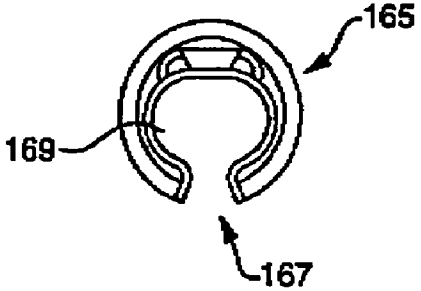
FIG. 15B is a cross-sectional view of the insert of FIG. 15A.
Figure 15A:
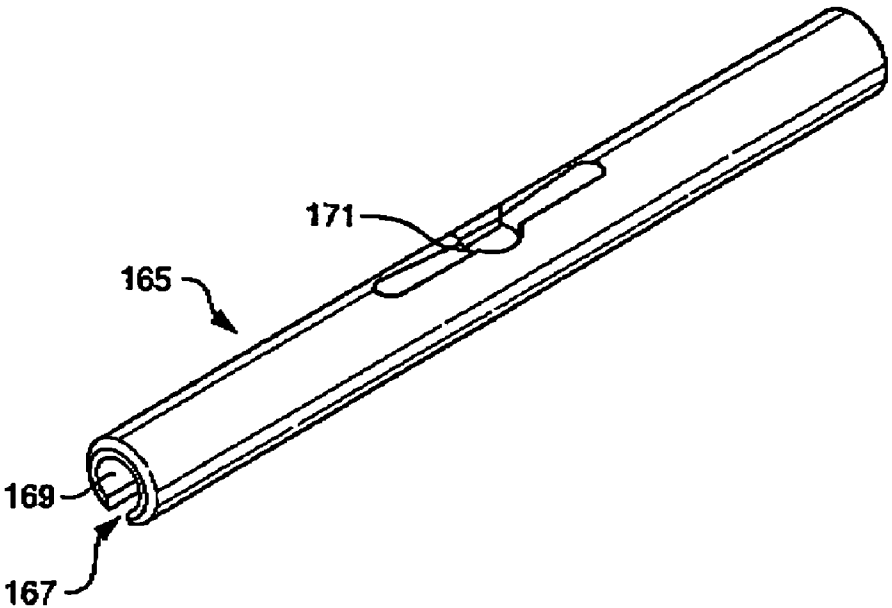
FIG. 15A is a perspective view of an insert for use in combination with the attachment device of FIG. 12.
Figure 15C:
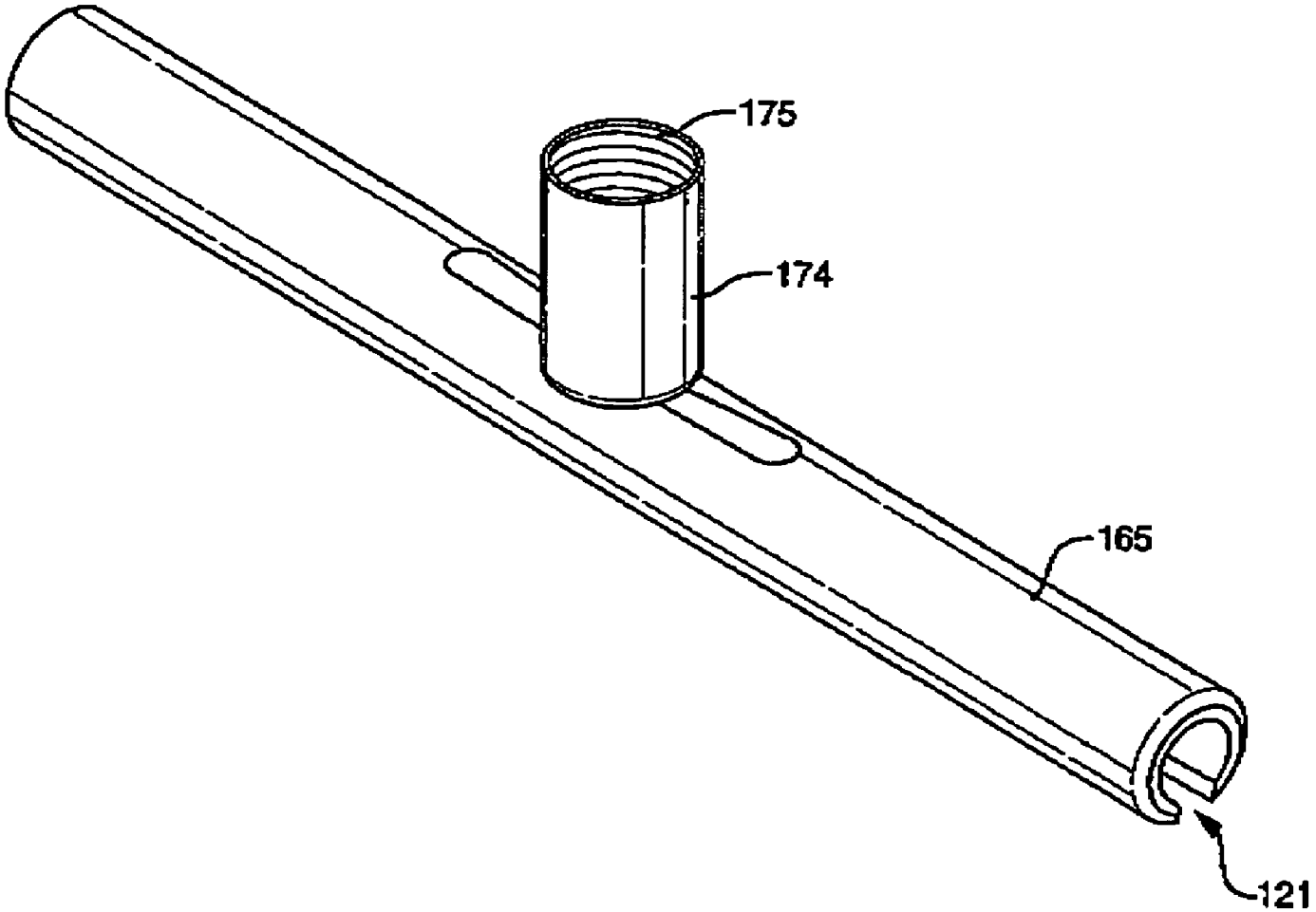
FIG. 15C is a perspective view of the insert of FIG. 15A with an attachment structure within the insert and a coupling device.

Another embodiment of an attachment structure is shown in FIGS. 15A-D. As shown in FIGS. 15A and 15B, in this embodiment an insert 165 comprises a hollow tube with an opening 167 on one side. The hollow tube has an inner wall 169 and an attachment opening 171. As shown in FIG. 15C, in use, the insert 165 is placed over the attachment structure 121 previously described. The attachment structure 121 slidingly fits within the insert 165. Preferably, the attachment structure 121 fits within the insert 165 such that there is sufficient friction to prevent the attachment structure 121 from sliding outwardly from the insert 165 during normal use of the roller mop. It should be understood that the invention is not limited in this regard, and other means may be used to attach the insert to the attachment structure, including, for example, pins on the inner surface of the insert which fit with corresponding holes on the attachment structure, an adhesive or other fastening devices.

Figure 16B:
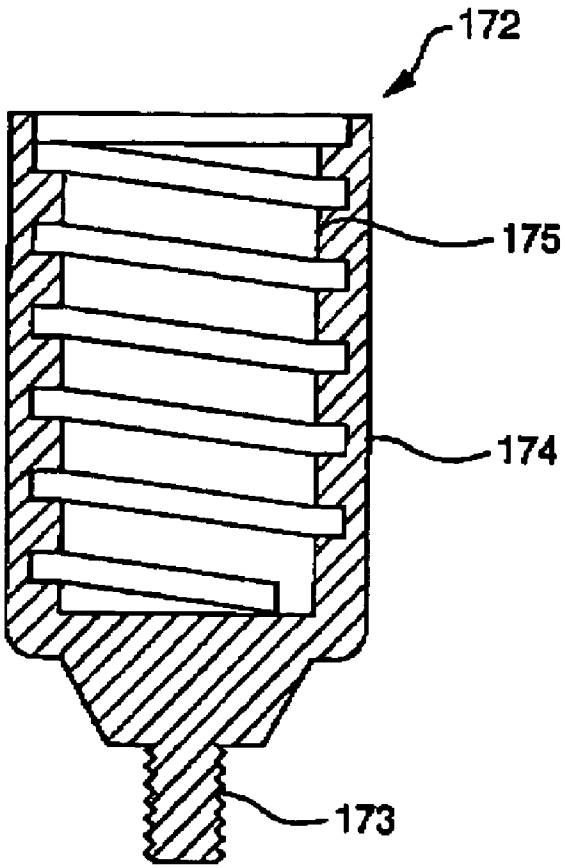
FIG. 16B is a cross-sectional view of the coupling device of FIG. 16A.
Figure 16A:
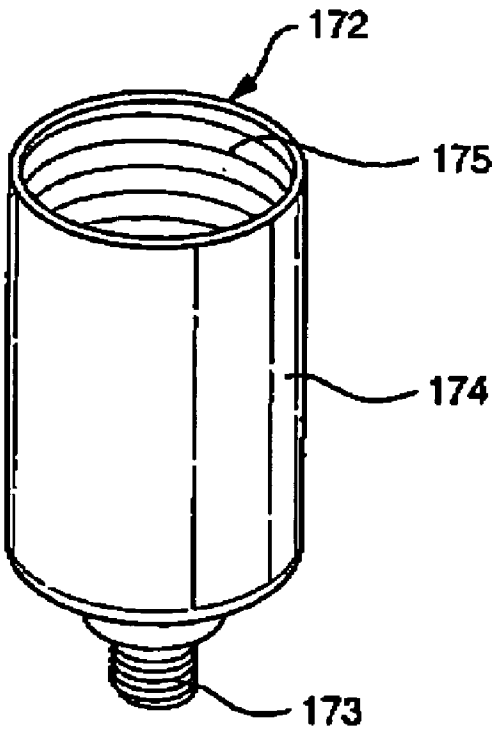
FIG. 16A is a front view of a coupling device.

The attachment opening 171 in the insert 165 is sized to accommodate a device for attachment to the handle of a roller mop. For example, as shown in FIGS. 15C, 16A and 16B, a coupling device 172 may be used to attach a mop handle to the insert and attachment structure. The coupling device comprises a cylindrical body portion 174 having a threaded portion 173 at a lower end of the body portion. The threaded portion 173 is sized and threaded to be received in a corresponding opening in the insert or the attachment structure as described below. The body portion 174 is hollow and the internal walls 175 are threaded to receive a the end of a correspondingly threaded mop handle (not shown).

The opening 171 of the insert may be threaded to receive the threaded portion 173 of the coupling device 172. Alternatively, the opening may be sized to allow the threaded portion 173 of the coupling to pass through the insert and be received in a threaded opening in the attachment structure 121 within the insert. The coupling device 172 has a second threaded portion 175 within the body of the coupling device which is sized to receive a correspondingly threaded portion of a handle, such as a roller mop handle.

Figure 15D:
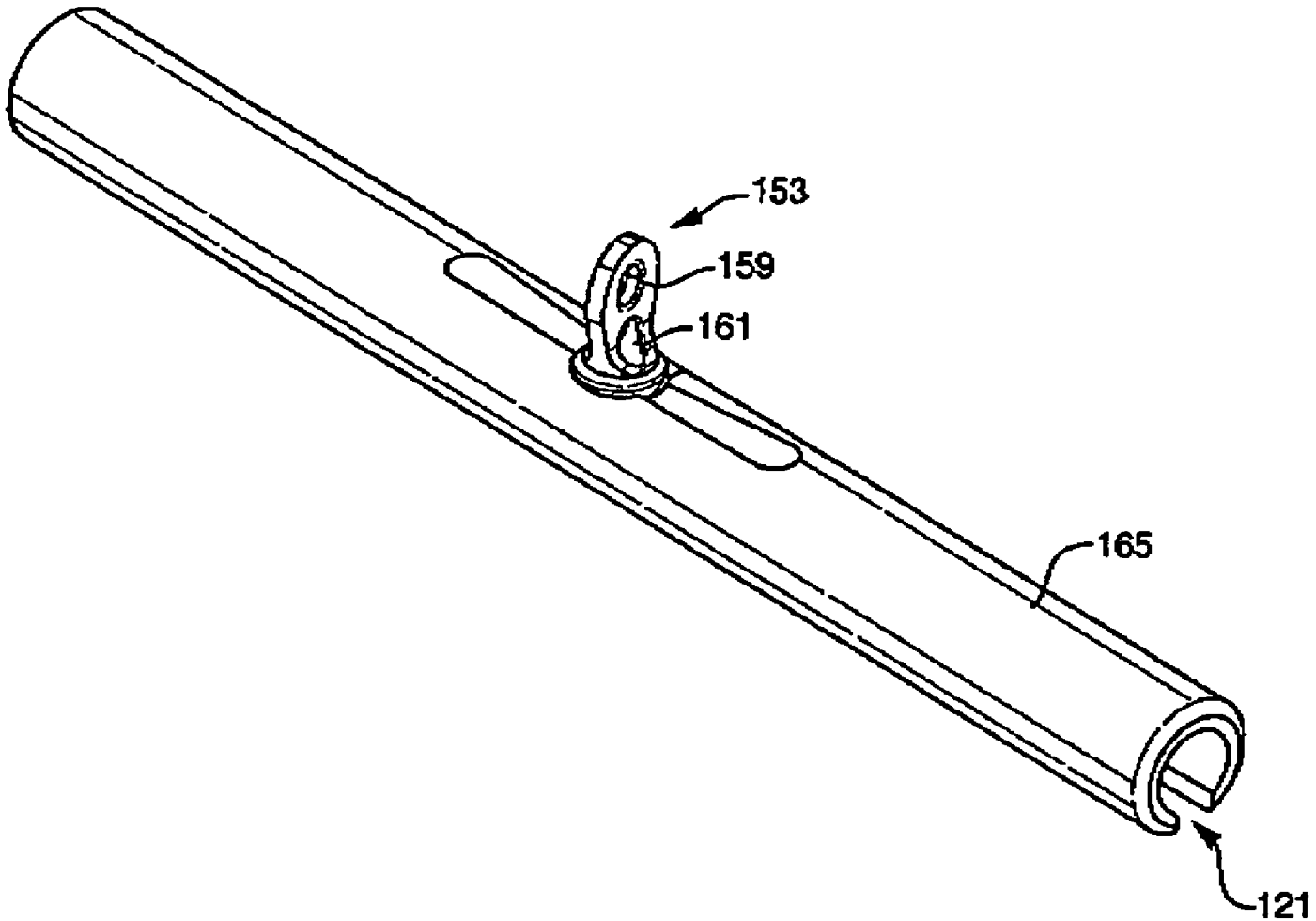
FIG. 15D is a perspective view of the insert of FIG. 15A with an attachment structure within the insert and an attachment screw device.

As shown in FIG. 15D, the screw device 153 shown in FIG. 14 may be attached to the insert 165 to allow the cleaning pad to be attached to a handle, such as a roller mop handle by means of a rod or other attachment device using one or both of the holes, 159, 161 as previously described.

It should also be noted that the present invention is not limited to use with sponge mops, and the disposable, removable cleaning pad comprising a backing plate or attachment structure, a layer of sponge and a layer of open cell foam material made of melanine resin could also be used in other types of hand held cleaning implements having an elongated handle such as toilet bowl brushes, scrub brushes and kitchen brushes as well as other types of mops. Moreover, the backing plate or attachment structure may be used with any type of disposable cleaning pad to allow the cleaning pad to be attached to any of a variety of different types of handles.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A disposable liquid absorbing cleaning pad for a roller mop, the roller mop including a handle, a sleeve movable relative to the handle and a pair of rollers on the sleeve, said disposable liquid absorbing cleaning pad comprising:

(a) a layer of a flexible open cell foam material made from melamine resin;

(b) a layer of sponge material fixedly attached to said layer of a flexible open cell foam material made from melamine resin; and (c) an attachment structure fixedly attached to the layer of sponge material for removably attaching the disposable liquid absorbing cleaning pad to the roller mop, wherein the attachment structure comprises (i) an elongated hollow tube having an outer surface and having an opening along one side of the hollow tube and an internal channel to fixedly attach a disposable cleaning pad to the attachment structure;

(ii) a plurality of slotted tabs on the outer surface of the elongated hollow tube opposite the opening for receiving rod type attachment devices; and (iii) a plurality of threaded openings through the elongated hollow tube opposite the opening for receiving screw type attachment devices.

2. The disposable liquid absorbing cleaning pad of claim 1, further comprising an elongated handle having a mop head attached to the handle at one and, wherein the mop head is attached to the attachment structure.

3. The disposable liquid absorbing cleaning pad with an elongated handle attached to the attachment structure of claim 2, wherein the mop head is attached to the attachment structure by at least one screw device comprising a threaded portion for attachment to a corresponding threaded opening in the attachment structure, a skirt portion and a flattened upper portion for gripping the screw device; and wherein the threaded portion of the screw device passes through an opening in the mop head and is threadedly attached to the attachment structure such that the skirt portion engages a surface on the mop head to secure the mop head to the attachment structure.

4. The disposable liquid absorbing cleaning pad with an elongated handle attached to the attachment structure of claim 2, wherein the, mop head is attached to the attachment structure using at least one screw device comprising a threaded portion for attachment to a corresponding threaded opening in the attachment structure, a skirt portion, a flattened upper portion for gripping the screw device, and at least one hole in the flattened portion is threadedly attached to the attachment structure; and at least one rod attached to the mop head, wherein the rod is sized to pass through the hole in the screw device to attach the mop head to the attachment structure.

5. The disposable liquid absorbing cleaning pad with an elongated handle attached to the attachment structure of claim 2, wherein the mop head is attached to the attachment structure using a coupling device, wherein the coupling device comprises a hollow cylindrical body portion having a first threaded portion at a lower end of the hollow cylindrical body portion that is sized to be received within a corresponding threaded opening in the attachment structure, and a second threaded portion within the interior of the body portion which is sized to receive a threaded handle.

6. The disposable liquid absorbing cleaning pad of claim 1, wherein the attachment structure further comprises an tubular insert which is sized to receive within the interior of the insert the elongated hollow tube having an opening along one side of the hollow tube and an internal channel to fixedly attach a disposable cleaning pad to the attachment structure.

* * * * *